US012449225B2

(12) United States Patent
Obteshka et al.

(10) Patent No.: US 12,449,225 B2
(45) Date of Patent: Oct. 21, 2025

(54) COCKING ASSEMBLY FOR CROSSBOW

(71) Applicant: Ravin Crossbows, LLC, Superior, WI (US)

(72) Inventors: Nicholas C Obteshka, Springfield, OR (US); Kevin P. Casey, Rochester, NY (US)

(73) Assignee: Ravin Crossbows, LLC, Superior, WI (US)

( * ) Notice: Subject to any disclaimer, the term of this patent is extended or adjusted under 35 U.S.C. 154(b) by 189 days.

(21) Appl. No.: 18/201,588

(22) Filed: May 24, 2023

(65) Prior Publication Data

US 2023/0408219 A1 Dec. 21, 2023

Related U.S. Application Data

(60) Provisional application No. 63/345,707, filed on May 25, 2022.

(51) Int. Cl.
*F41B 5/12* (2006.01)

(52) U.S. Cl.
CPC ..... *F41B 5/12* (2013.01)

(58) Field of Classification Search
CPC ..... F41B 5/12; F41B 5/123
See application file for complete search history.

(56) References Cited

U.S. PATENT DOCUMENTS

| | | | | |
|---|---|---|---|---|
| 9,958,232 | B1 * | 5/2018 | Egerdee | F41B 5/1403 |
| 10,690,436 | B1 * | 6/2020 | Kempf | F41B 5/1469 |
| 11,131,524 | B1 * | 9/2021 | Kempf | F41B 5/123 |
| 11,221,191 | B2 * | 1/2022 | Bednar | F41B 5/1469 |
| 11,306,994 | B2 * | 4/2022 | Shaffer | F41B 5/123 |
| 11,796,277 | B2 | 10/2023 | Mcpherson | |
| 12,000,668 | B2 | 6/2024 | Mcpherson | |
| 12,000,669 | B2 | 6/2024 | Mcpherson et al. | |

* cited by examiner

*Primary Examiner* — John A Ricci
(74) *Attorney, Agent, or Firm* — Foley & Lardner LLP

(57) ABSTRACT

A cocking assembly includes a rail, a drawstring carrier, and an actuator. The rail includes a front end and a rear end. The drawstring carrier is configured to retain a drawstring and move in a rearward direction to draw the drawstring. The actuator is operatively coupled to the drawstring carrier and configured to move along the rail between the front end to the rear end to draw the drawstring carrier in the rearward direction.

20 Claims, 31 Drawing Sheets

COCKING ASSEMBLY FOR CROSSBOW

CROSS REFERENCE TO RELATED PATENT APPLICATION

This application claims the benefit of and priority to U.S. Provisional Patent Application 63/345,707, filed May 25, 2022, which is incorporated herein by reference in its entirety.

BACKGROUND

Crossbows utilize a string that is drawn backward and released to fire a projectile. Flexible limbs are loaded with force by the drawstring being drawn, and limbs are unloaded with force when the crossbow is fired to aggressively power the movement of the drawstring toward the front of the crossbow.

Crossbows are generally drawn by pulling a drawstring rearward from a front end of the crossbow. Movement of the drawstring rearward may require a significant amount of input force. To make it easier for users to draw the crossbow, various systems have been developed. These systems include cranks and tethers. In some cases, these systems include multiple parts that are capable of being damaged or lost in the field. In other cases, these systems require high amounts of user input force to use.

Dry firing occurs when a crossbow is fired before the user has properly loaded a projectile. Dry fires can occur, for example, if a user's fingers slip when operating a loading system such as a crank or a tether. Dry firing a crossbow can result in damage to the crossbow. Therefore, improvements are desired.

SUMMARY

In general terms, this disclosure is directed to a cocking assembly for a crossbow. Specifically, the disclosure relates to a crossbow that includes one or more of a sliding assembly and/or a spooling assembly. Other aspects include but are not limited to the following.

One aspect of the present disclosure is related to a cocking assembly for a crossbow. The cocking assembly includes a rail, a drawstring carrier, and an actuator. The rail includes a front end and a rear end. The drawstring carrier is configured to retain a drawstring and move in a rearward direction to draw the drawstring. The actuator is operatively coupled to the drawstring carrier and configured to move along the rail between the front end to the rear end to draw the drawstring carrier in the rearward direction.

Another aspect of the present disclosure is related to a cocking assembly for a crossbow. The cocking assembly includes rail having a front end and a rear end. The cocking assembly includes a drawstring carrier, an actuator, and a spool. The actuator is operatively coupled to the rail and configured to move along the rail between the front end and the rear end. The spool is operatively coupled to the actuator and configured to rotate with a movement of the actuator along the rail. A rotational movement of the spool is configured to move the drawstring carrier in a rearward direction.

Another aspect of the present disclosure is related to a crossbow. The crossbow includes a drawstring and a cocking assembly. The cocking assembly includes a rail having a front end and a rear end. The cocking assembly includes a drawstring carrier and an actuator. The drawstring carrier is configured to retain the drawstring and draw the drawstring towards a rear end of the crossbow. The actuator is configured to move along the rail between the front end to the rear end to draw the drawstring carrier towards the rear end of the crossbow.

DETAILED DESCRIPTION

Figure 1:
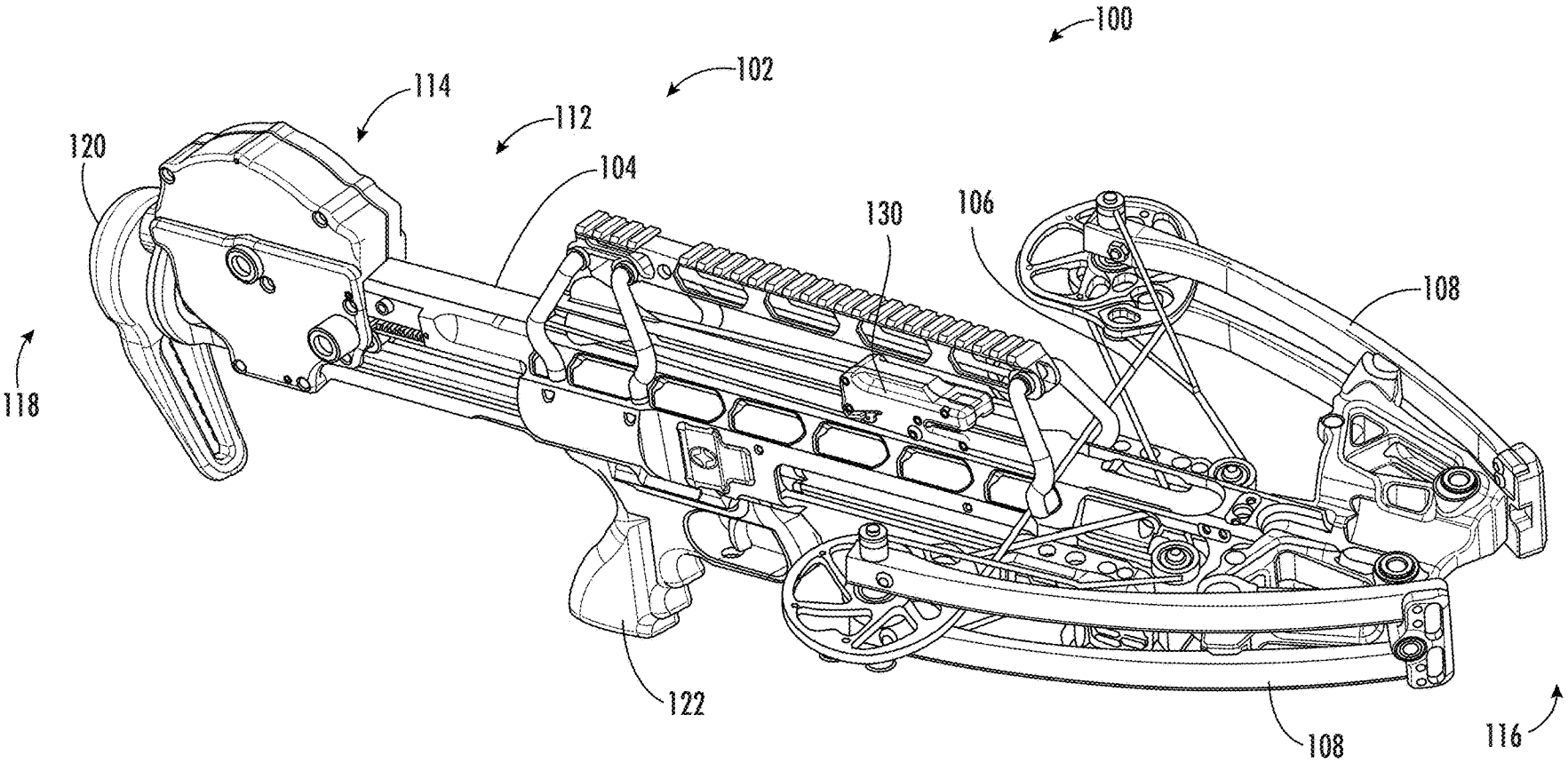
FIG. 1 is a perspective view of a crossbow in an undrawn position, according to an exemplary embodiment.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The crossbows disclosed herein can be used in a variety of different arrangements to improve the efficiency and the ease of loading the crossbow. The cocking assembly disclosed herein reduces the likelihood of, and problematic effects associated with, a user releasing an actuator (e.g., a slide, a handle, a lever, a pump, a stirrup) before the crossbow is fully loaded. This cocking assembly also makes the crossbow easier to load and operate.

FIG. 1 shows a perspective view of an example crossbow 100 in an undrawn position. As shown in FIG. 1, the crossbow 100 includes a cocking assembly 102. In some examples, the cocking assembly 102 also includes a sliding assembly 112 and/or a spooling assembly 114. The cocking assembly 102 allows the crossbow 100 to be drawn from an undrawn position into a drawn position (shown in FIG. 2).

The sliding assembly 112 is operatable by a user and is operable to receive an input force from a user. The sliding assembly 112 transfers the input force from the user to the spooling assembly 114. The spooling assembly 114 uses the force from the sliding assembly 112 to draw and load the crossbow 100. In some examples, the sliding assembly 112 provides a force to the spooling assembly 114 in the form of linear motion. The spooling assembly 114 then converts the linear motion into rotational motion, which results drawing of the crossbow 100. In some embodiments, the sliding assembly 112 also prevents an inadvertent release of stored energy within the crossbow 100 system if the user suddenly stops applying the input force to the sliding assembly 112.

Figure 2:
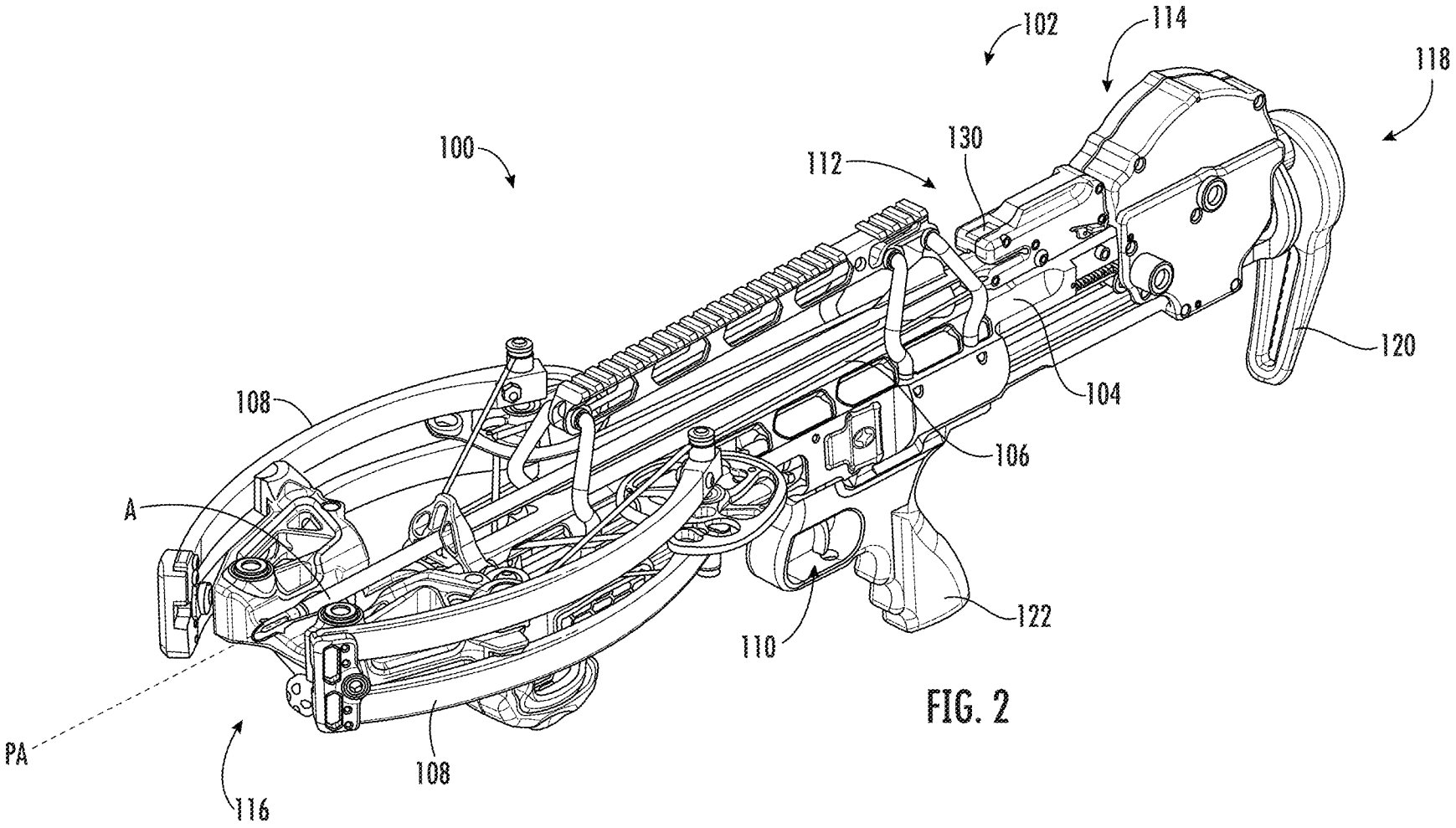
FIG. 2 a perspective view of the crossbow of FIG. 1 in a drawn position, according to an exemplary embodiment.

FIG. 2 is a perspective view of the crossbow 100 in a drawn position. As shown in FIG. 2, in some embodiments, the crossbow 100 further includes a frame 104, a drawstring 106, one or more limbs 108, and/or a trigger assembly 110.

The crossbow 100 is configured to fire a projectile, such as an arrow A, along a projectile axis PA. One example of an arrow is a bolt. In certain embodiments, projectile is an arrow with a pointed tip and fletching to help stabilize the projectile as the projectile moves through the air when the projectile is fired from the crossbow 100. The arrow can include a removable tip, and the tip can be a broadhead or target tip, for example, or a variety of other possible tips.

In general, to operate the crossbow 100, a user holds the frame 104 and draws the drawstring 106 away from a front end 116 of the crossbow 100 and towards a rear end 118 of the crossbow 100, using the cocking assembly 102. As the drawstring 106 is drawn rearward, the flexible limbs 108 are loaded and provide resistance to the movement of the drawstring 106 rearward. Once the drawstring 106 has been drawn rearward into a drawn position, a projectile, such as an arrow A, is then placed on the frame 104 and coupled to the drawstring 106. By operating the trigger assembly 110, the user is able to release the drawstring 106 from the cocking assembly 102. The limbs 108 power the drawstring 106 forward and propel the projectile out from the front of the crossbow 100.

The frame 104 is the main body of the crossbow 100, and is generally formed as a rigid structure that supports other components of the crossbow 100. The frame 104 can be constructed of variety of materials including carbon fiber composite, wood, metal (such as aluminum), plastic, or other suitable materials. In other examples, the frame 104 has a one-piece construction, and in other embodiments the frame 104 has a multiple-piece construction. Frame 104 may include a variety of mounting points (which can be part of one or more accessory mounting rails, etc.) for attaching various modular accessories such as a quiver, a scope, a flashlight, or other attachments.

In some embodiments the frame 104 includes a stock 120 at a rear end 118. In some examples, the stock 120 may be integrally formed with frame 104 as a singular unibody component. The stock 120 can be arranged to press against a shoulder or chest of the operator when the crossbow 100 is held in the firing position, such as to help stabilize the crossbow 100 while aiming and shooting. In some embodiments, the stock 120 also functions as a housing for components of the spooling assembly 114.

In some embodiments, the frame 104 also includes a grip 122. The grip 122 provides a handle for the crossbow 100. A user can hold onto the grip 122 when carrying, aiming, and shooting the crossbow 100. The grip 122 can be held by the user's hand, including when operating the trigger assembly 110. The grip 122 assists the user in stabilizing the crossbow 100 during firing and handling. In some embodiments, the grip 122 is formed integrally with the frame 104. In some embodiments the grip 122 is detachable from the frame 104. In some embodiments, the crossbow 100 has a plurality of grips 122.

The limbs 108 provide power to propel the projectile A forward along the projectile axis PA. In some embodiments, as depicted in FIG. 2, the limbs 108 extend in an outward direction from the projectile axis PA and in a rearward direction toward the rear end 118 of the crossbow 100. The limbs 108 are positioned at either side of the projectile axis PA such that the projectile A passes between the limbs 108 when the crossbow 100 is fired.

In another possible embodiment, the limbs 108 extend in an outward direction from the projectile axis PA and/or in a forward direction toward the front end 116 of the crossbow 100. In some examples, the limbs 108 extend in an upward direction from projectile axis PA and/or in a forward direction toward the front end 116 of the crossbow 100. In some examples, the limbs 108 extend in an upward direction from projectile axis PA and/or in a rearward direction toward the rear end 118 of the crossbow 100. Limbs 108 may be positioned in a variety of different ways relative to the projectile axis PA without departing from the principles of this disclosure.

In some examples, the limbs 108 may be replaced with an alternative power source. In some examples, other power sources can include, for example, spring(s) and/or motor(s). Additionally, some embodiments include multiple power sources in combination.

The drawstring 106 provides power to the projectile A when the crossbow 100 is fired. In some examples, the drawstring 106 extends across the projectile axis PA. In some examples, the drawstring 106 extends between the ends of the limbs 108. The drawstring 106 can be formed from any fiber. In some examples, the drawstring 106 is formed from a linen or hemp fiber. In other examples, the drawstring 106 is formed from polyester, polymer, or polyethylene materials. In some examples, the drawstring 106 is formed from composite fibers.

The trigger assembly 110 functions to release the drawstring 106 so that the projectile P can be fired. In some embodiments, the trigger assembly 110 includes a trigger. In some embodiments, the trigger assembly 110 also includes a linkage system that allows for the drawstring 106 to be released when the trigger is pulled. When the trigger assembly 110 is operated to release the drawstring 106, the drawstring 106 moves in a forward direction. The movement of the drawstring 106 in the forward direction propels the drawstring 106 from the front end 116 of the crossbow 100.

Figure 3:
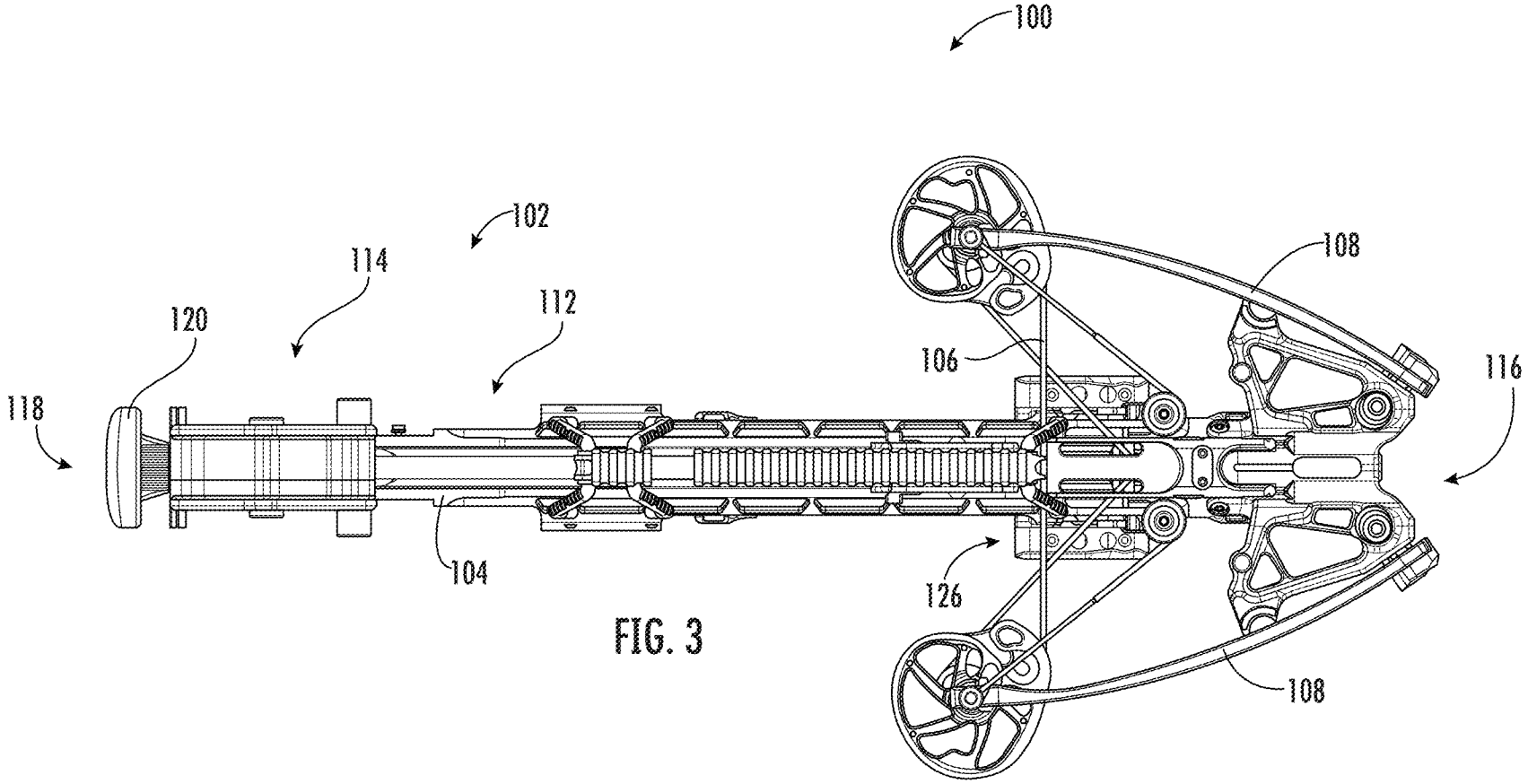
FIG. 3 is a top view of the crossbow of FIG. 1, according to an exemplary embodiment.
Figure 4:
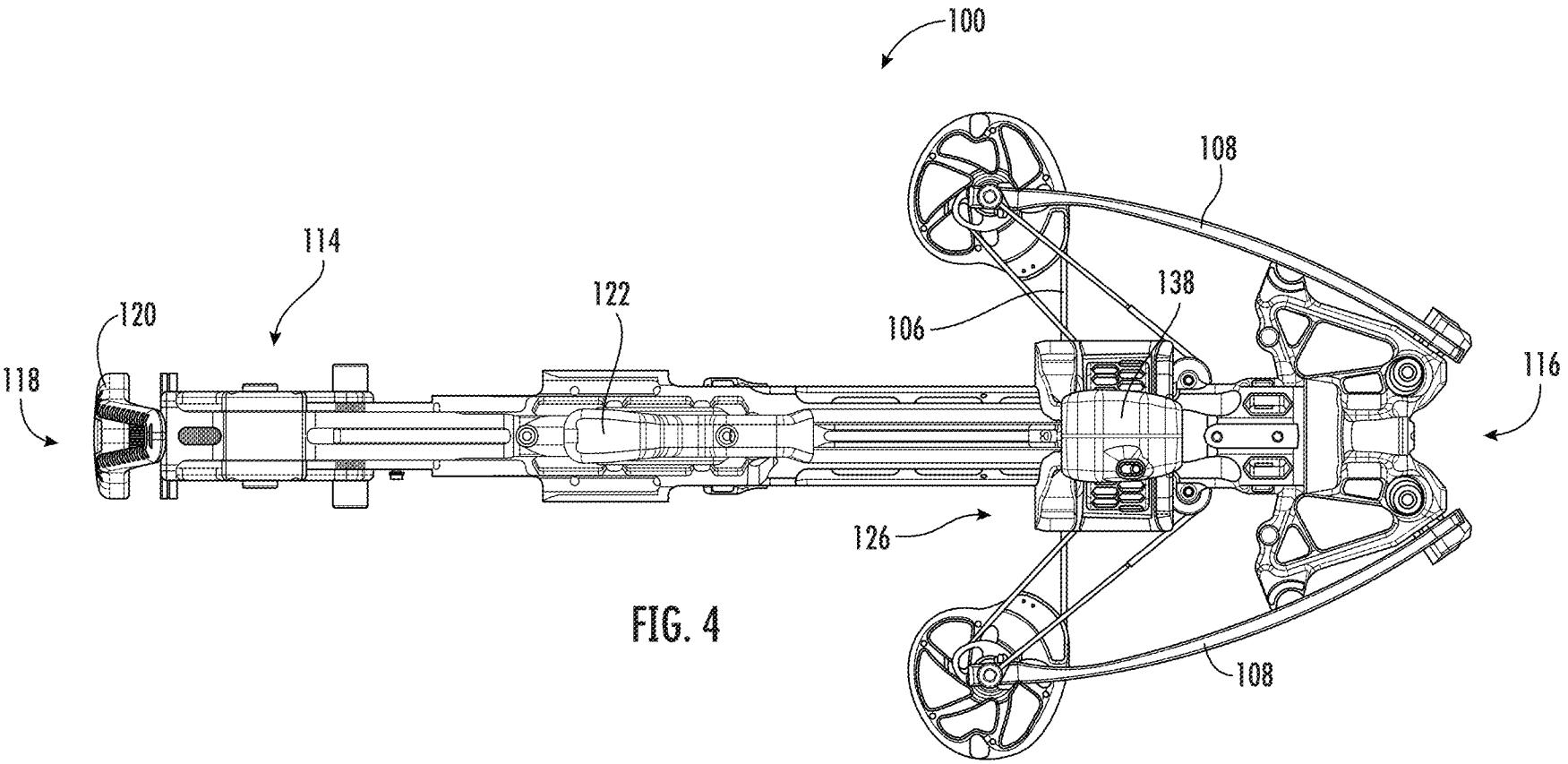
FIG. 4 is a bottom view of the crossbow of FIG. 1, according to an exemplary embodiment.
Figure 5:
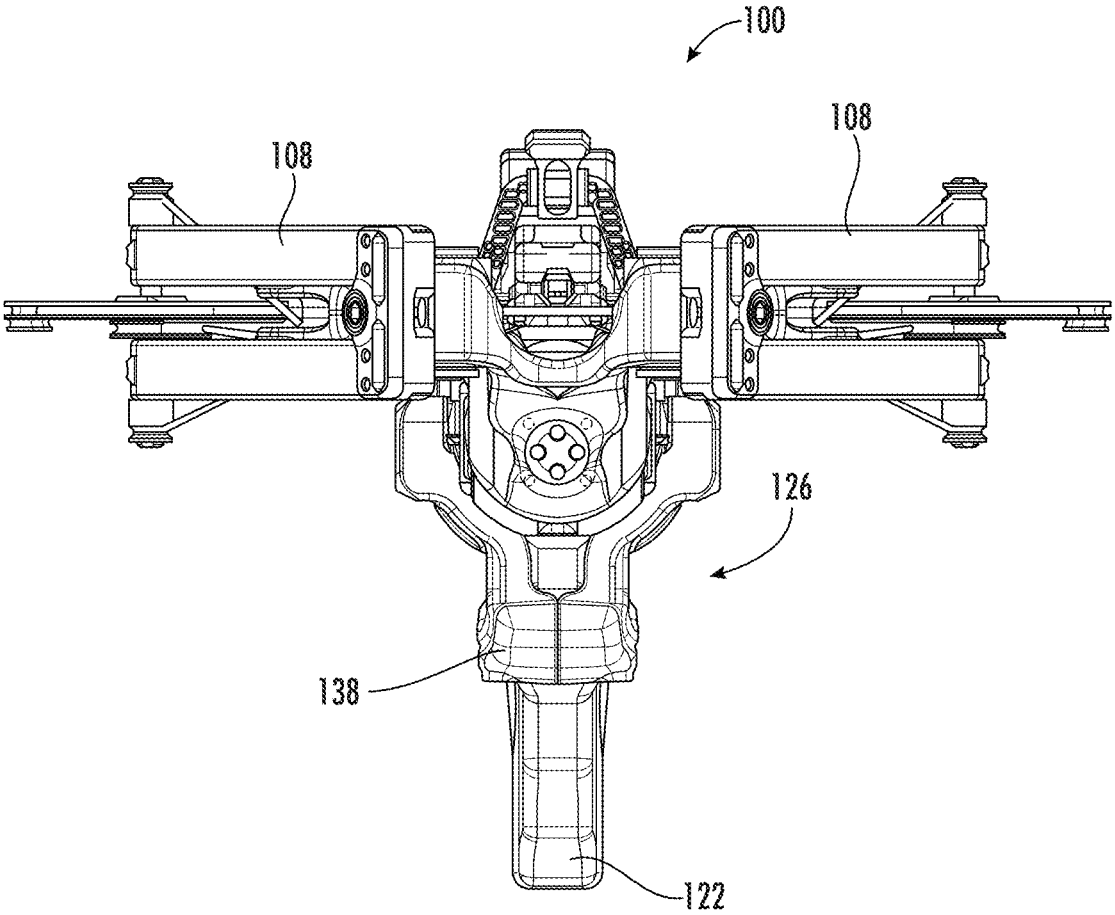
FIG. 5 is a front view of the crossbow of FIG. 1, according to an exemplary embodiment.
Figure 6:
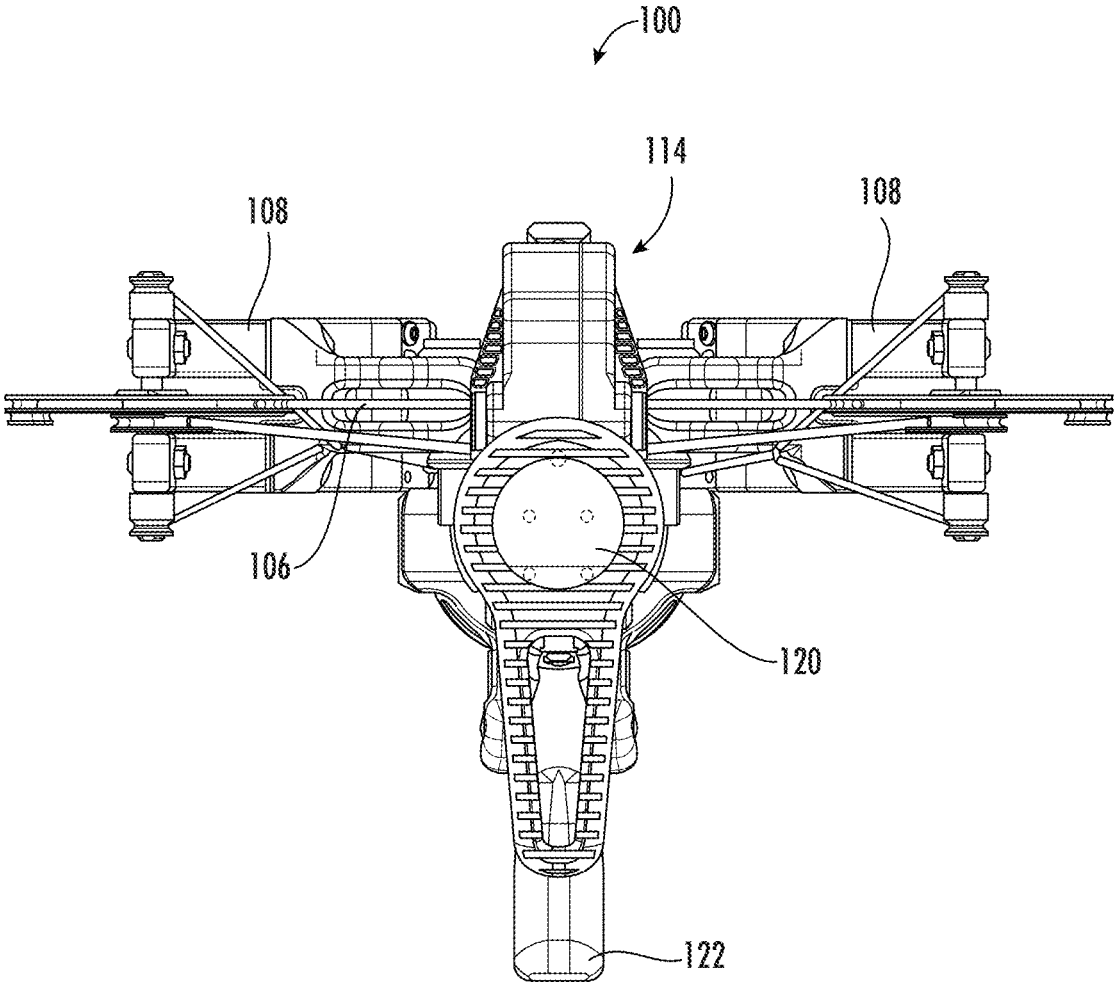
FIG. 6 is a rear view of the crossbow of FIG. 1, according to an exemplary embodiment.

FIGS. 3-6 show alternative views of the crossbow 100 in the undrawn position. FIG. 3 is a top view of the crossbow 100, and FIG. 4 is a bottom view of the crossbow 100. FIG. 5 is a front view of the crossbow 100, and FIG. 6 is a rear view of the crossbow 100.

Figure 7:
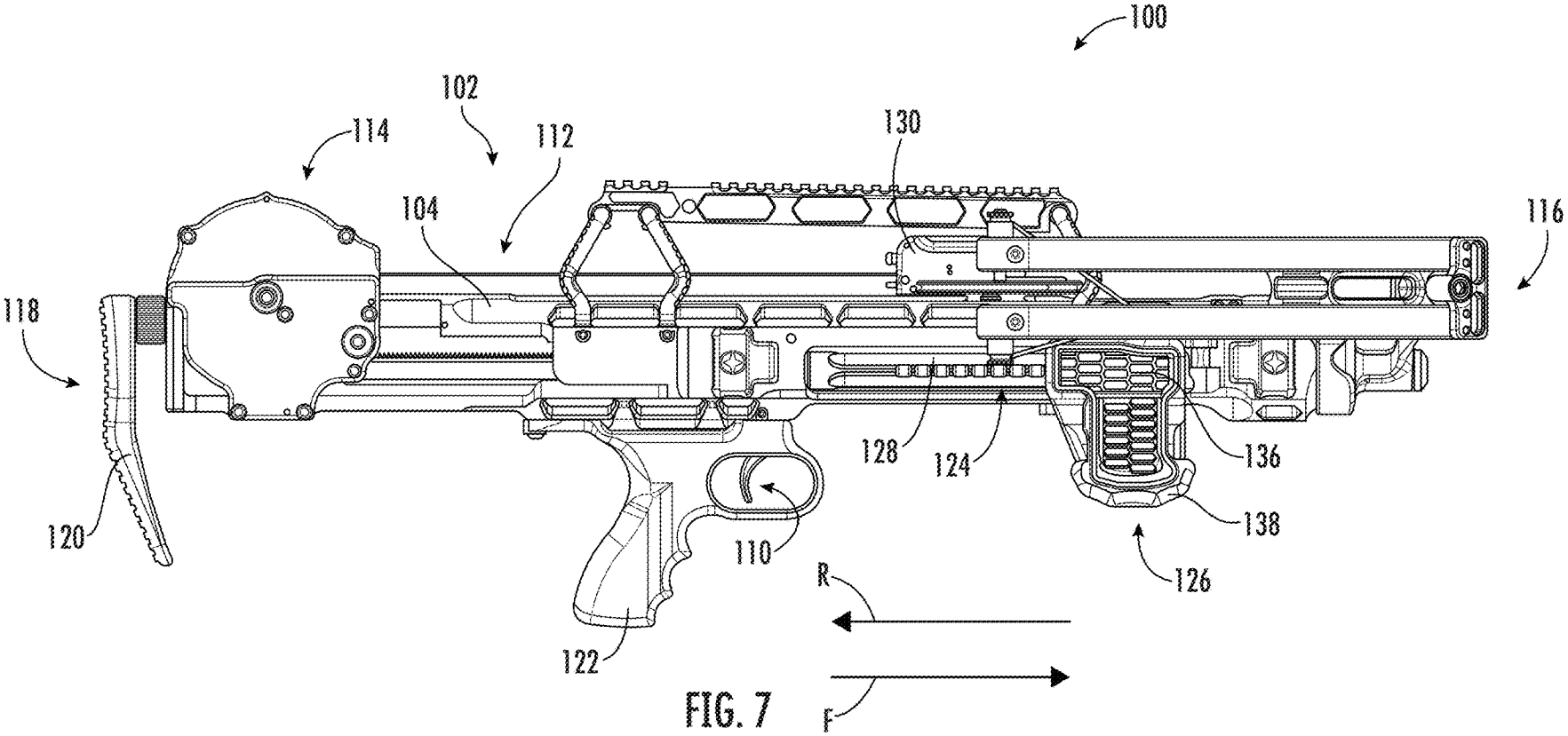
FIG. 7 is a side view of the crossbow of FIG. 1 with the limbs removed, according to an exemplary embodiment.

FIG. 7 is a side view of the example crossbow 100 with the limbs 108 removed. In the example crossbow 100 of FIG. 7, the cocking assembly 102 is shown. As noted with reference to FIG. 1, in some embodiments, the cocking assembly 102 includes a sliding assembly 112 and/or a spooling assembly 114.

In some examples, the spooling assembly 114 includes a drawstring carrier 130. The spooling assembly 114 is operable to bring the drawstring carrier 130 rearward. The drawstring carrier 130 is operable to selectively retain the drawstring 106 so that as the drawstring carrier 130 is brought rearward, the drawstring 106 is also brought rearward (e.g., draw the drawstring 106 rearward). The spooling assembly 114 is discussed in greater detail with reference to FIGS. 17-27.

The sliding assembly 112 includes a rail 124 and an actuator 126, shown as a slide 126. The actuator 126 can be the slide 126, a lever, a pump, a stirrup, or some other actuator or actuators. In some examples, the sliding assembly 112 operates to prevent a dry fire as the crossbow 100 is being loaded. In the embodiment of FIG. 7, the rail 124 is shown as being housed within the frame 104 of the crossbow 100, such that the frame 104 is positioned around the rail 124. In some embodiments, the rail 124 is not enclosed, and instead is formed as a part of the frame 104 of the crossbow 100. The rail 124 includes a slide track 128. The slide 126 is slidably coupled to the rail 124 and is configured to be slid along the slide track 128 on the rail 124 by a user to draw the drawstring carrier 130 and the drawstring 106. In some examples, the slide 126 is able to slide from a front end of the rail 124 to a rear end of the rail 124 in the direction of rearward arrow R (shown in FIG. 28 as 126*a* and 126*b*). In other examples, the slide 126 is able to slide from a rear end of the rail 124 to a front end of the rail 124 in the direction of forward arrow F. In some examples, movement of the slide 126 on the rail 124 along the slide track 128 corresponds to movement of the drawstring carrier 130 in a rearward direction. Thus, when the drawstring carrier 130 is coupled to the drawstring 106, movement of slide 126 along the rail 124 corresponds to movement of the drawstring 106 in a rearward direction. The movement of the slide 126 and the drawstring carrier 130 are described in greater detail with reference to FIG. 28.

Figure 8:
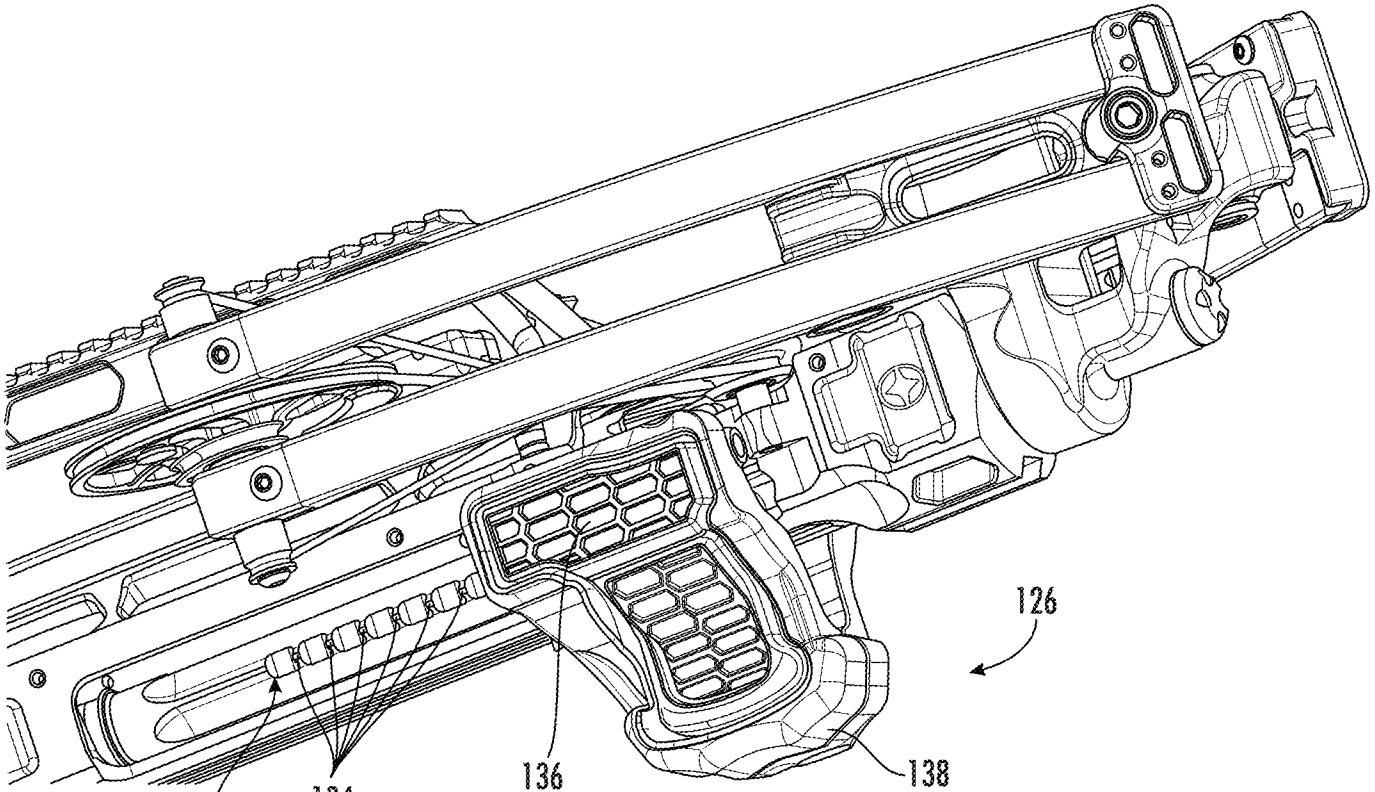
FIG. 8 is a bottom perspective view of a portion of the crossbow of FIG. 1, according to an exemplary embodiment.

FIG. 8 shows the slide 126 (e.g., the actuator 126) and the rail 124 of the sliding assembly 112. In the example of FIG. 8, the rail 124 includes engagement features 134. The engagement features 134 are shown and described in greater detail with reference to FIGS. 9-10. In some examples, the engagement features 134 are protrusions that extend out from the rail 124 along a length of the rail 124. In some embodiments, the slide 126 is operable to releasably couple to the engagement features 134. In this way, as the slide 126 is grasped by a user and slid in a forward and rearward direction, the slide 126 does not engage with the engagement features 134. For example, an actuation of a button, lever, or other mechanism on the slide 126 (e.g., via a user's grasping action) can cause the slide 126 to disengage from the engagement features 134. In some examples, the slide 126 can be disengaged from the engagement features 134 for an indefinite period of time based on a single actuation (e.g., a flip of a switch). In other examples, the slide 126 can remain disengaged from the engagement features 134 only during a sustained actuation of a button, lever, or other mechanism of the slide 126. For example, once the slide 126 is released by the user, the slide 126 engages with one of the plurality of engagement features 134, which prevent the slide 126 from moving.

In the example of FIG. 8, the slide 126 includes a slide grip 138 and an engagement selector 136. In the example of FIG. 8, the slide grip 138 is shown as a pump-style grip, however, in other examples, the slide grip 138 is a horizontally or vertically oriented handle. In some examples, the slide grip 138 is made up of multiple handles so that a user can grasp the slide grip 138 with both hands, with a foot, with some other appendage, or with some other component or device (e.g., a mountable handle). In some examples, the slide grip 138 is customizable so that a user is able to select a desired style of slide grip 138.

In some examples, the slide 126 includes an engagement selector 136. The engagement selector 136 is operable by a user to place the slide 126 in an engagement mode, in which the slide 126 engages with the engagement features 134 of the rail 124 to arrest (e.g., slow, stop, retard, or otherwise inhibit) the movement of the slide 126. The engagement selector 136 is further operable to place the slide 126 in a disengagement mode, in which the slide 126 disengages with the engagement features 134 of the rail 124 so that the slide 126 is freely slidable along the rail 124. As shown in the example of FIG. 8, the engagement selector 136 is a depressible button. However, in other examples, the engagement selector 136 is a lever, switch, slider, or other manipulable feature.

Figure 9:
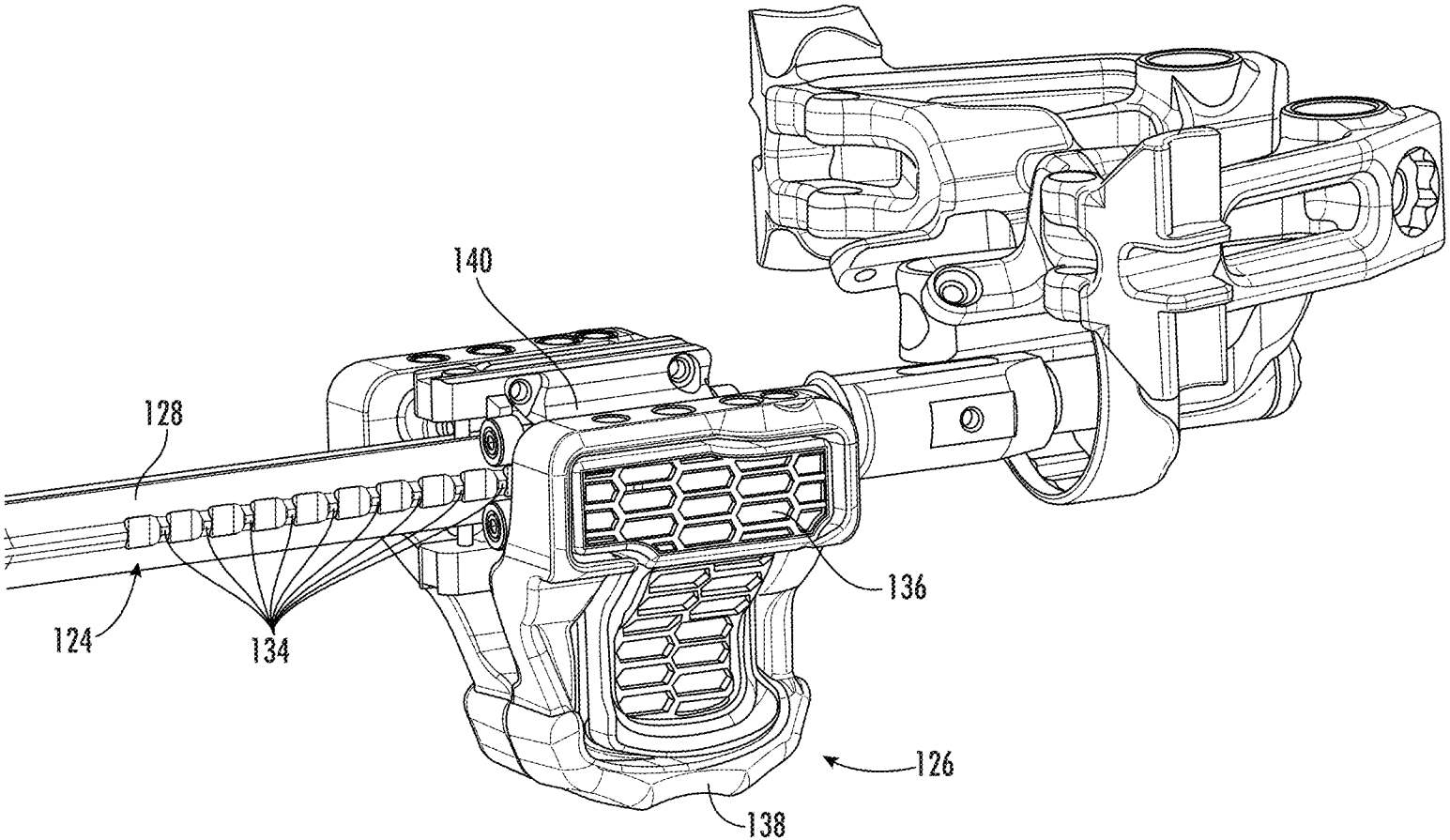
FIG. 9 is a side view of a sliding assembly, according to an exemplary embodiment.
Figure 10:
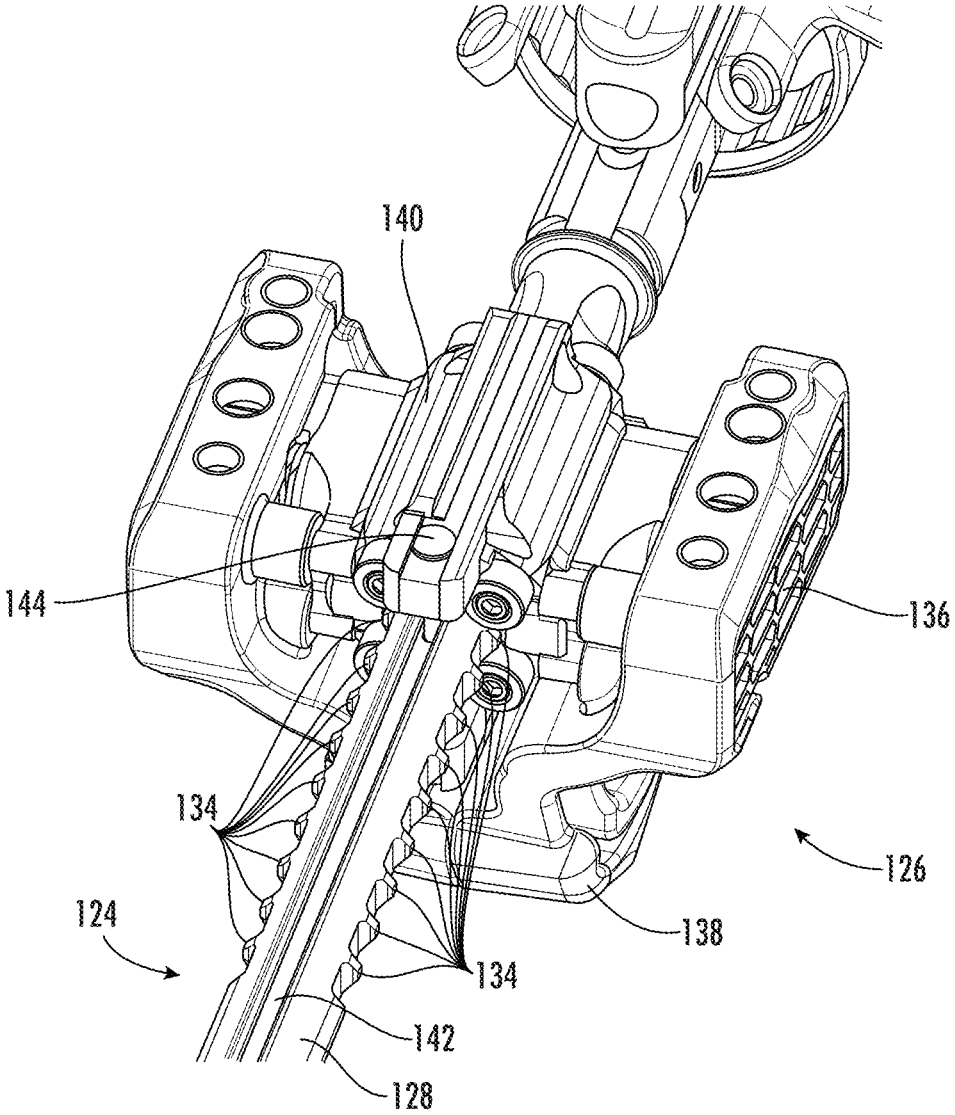
FIG. 10 is a top perspective view of an actuator and a rail of the sliding assembly of FIG. 9, according to an exemplary embodiment.
Figure 12A:
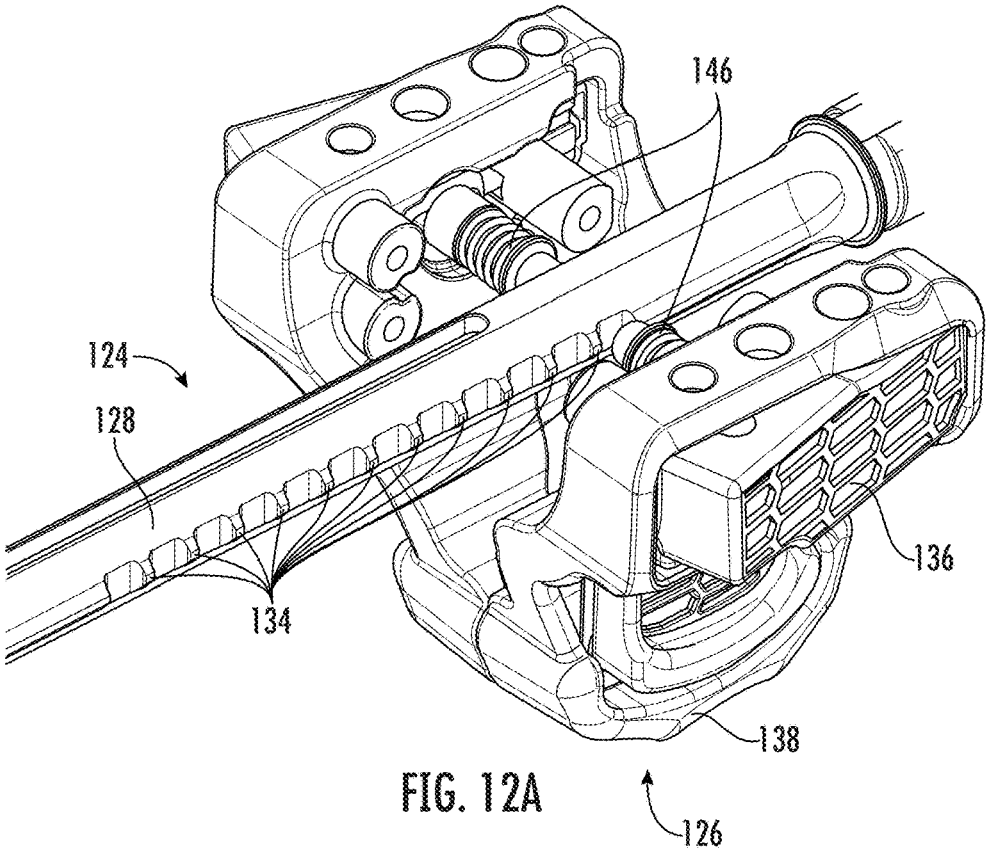
FIG. 12*a* is a front perspective view of the sliding assembly of FIG. 9 with the engagement pistons in a disengaged position and a portion of the rail sheath removed, according to an exemplary embodiment.
Figure 12B:
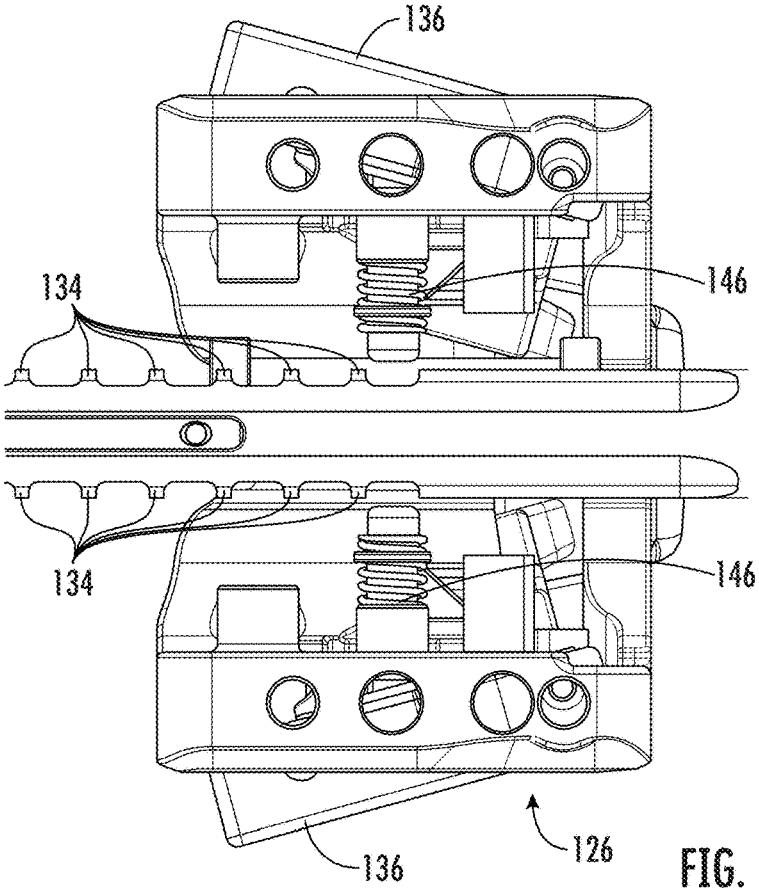
FIG. 12*b* is a front perspective view of the sliding assembly of FIG. 9 with the engagement pistons in a disengaged position and a portion of the rail sheath removed, according to an exemplary embodiment.

FIGS. 9-10 are perspective views of the slide 126 and rail 124 of the sliding assembly 112 with the frame 104 removed. As depicted in FIG. 9, the rail 124 includes engagement features 134. In the example of FIGS. 12*a* and 12*b*, the rail 124 includes a flat side with a plurality of engagement features 134 arranged linearly along the length of the rail 124. The engagement features 134 are shown as ridges protruding out from the flat side of the rail 124. In the example of FIG. 9, the engagement features 134 are positioned on each side of the rail 124, however, in some examples, the engagement features 134 are only located on one side of the rail 124.

As noted above, the slide 126 includes the slide grip 138 and the engagement selector 136. As visible in FIGS. 9-10, the slide 126 also includes a rail sheath 140. In the example of FIGS. 9-10, the rail sheath 140 is connected to the slide grip 138 and surrounds the rail 124. The rail sheath 140 functions to couple the slide 126 to the rail 124 while allowing the slide 126 to slide along the rail 124.

FIG. 10 depicts the slide 126 and rail 124 of the sliding assembly 112. As visible in FIG. 10, in some examples, the sliding assembly 112 also includes a linear coupling member 142, shown as a rod 142. The linear coupling member 142 can be the rod 142, one or more linkages, or some other member or members to couple to the sliding assembly 112. The sliding assembly 112 further includes at least one connecting pin 144.

In FIG. 10, the rod 142 is housed within the rail 124, however, in other examples, the rod 142 is positioned outside of the rail 124. In some examples, the rod 142 is placed parallel to the rail 124. The rod 142 is coupled to the slide 126.

In some examples, the rail sheath 140 of the slide 126 is connected to the rod 142 by the one or more connecting pins 144. The rod 142 is coupled to the slide 126 so that as the slide 126 is slid along the rail 124, in a forward and rearward direction, the rod 142 moves in a forward and rearward direction corresponding to the movement of the slide 126. Likewise, if the slide 126 stops sliding, such as in instances where the engagement selector 136 is placed into the engagement mode, the movement of the rod 142 is also stopped.

Figure 11A:
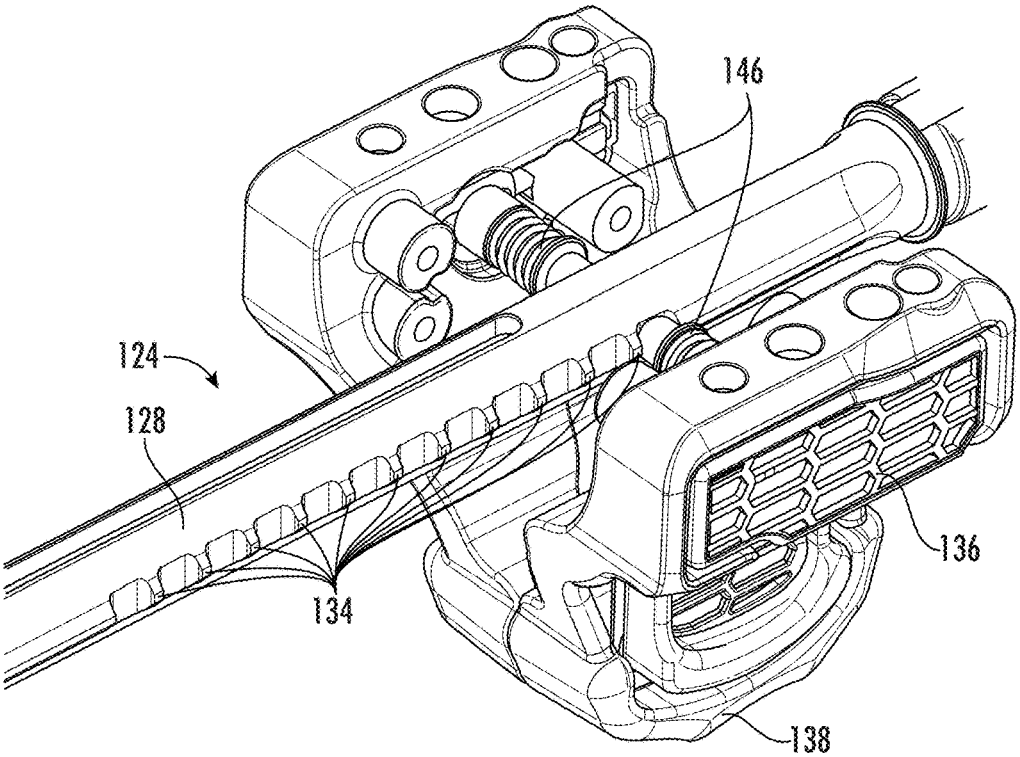
FIG. 11*a* is a top perspective view of a portion of a slide and rail of the sliding assembly of FIG. 9 with engagement pistons in an engaged position and a portion of a rail sheath removed, according to an exemplary embodiment.
Figure 11B:
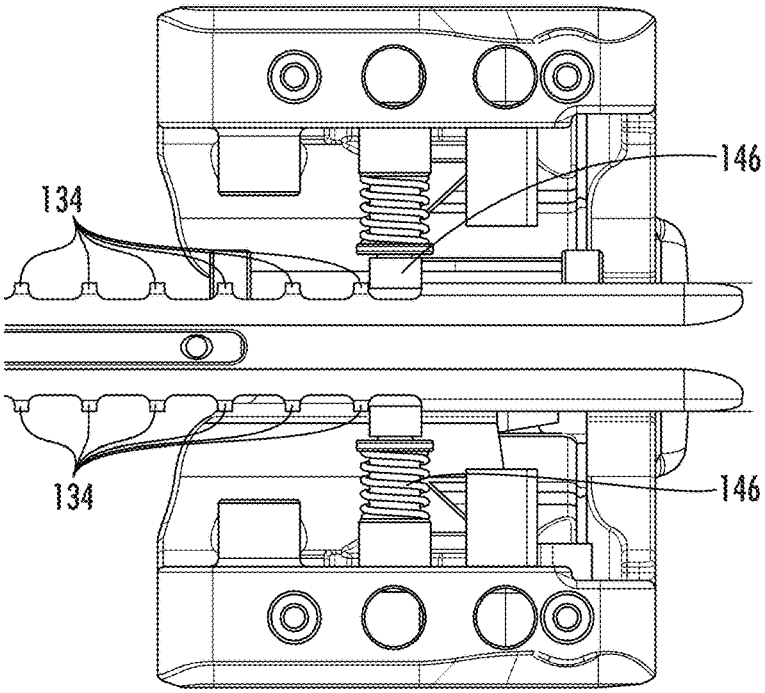
FIG. 11*b* is a top view of a portion of a slide and rail of the sliding assembly of FIG. 9 with engagement pistons in an engaged position and a portion of a rail sheath removed, according to an exemplary embodiment.

FIG. 11*a* is a perspective view of the slide 126 and the rail 124. FIG. 11*b* is a top view of the slide 126 and the rail 124. As depicted in FIGS. 11*a* and 11*b*, the slide 126 further includes an engagement piston 146, shown in an engaged position. The engagement piston 146 is moveable between the engaged position and a disengaged position (shown in FIGS. 12*a* and 12*b*). As depicted in FIGS. 11*a* and 11*b*, the engagement piston 146 is engaged with at least one engagement feature 134.

In the engaged position, the engagement piston 146 is placed into contact with the rail 124. When placed into contact with the rail 124, the engagement piston 146 is locked into a space on the rail 124 between the engagement features 134. When placed into the engaged position, the slide 126 is no longer movable because the engagement features 134 prevent the engagement piston 146 from moving forward and backward direction along the rail 124. In some examples, when the engagement piston 146 is placed into the engaged position, the slide 126 is partially moveable, as the engagement piston 146 is able to move back and forth between two engagement features 134. In other examples, the engagement features 134 are positioned close together so that the space in between the engagement features 134 are not large enough for the engagement piston 146 to move back and forth within the space between the engagement features 134.

FIG. 12*a* is a perspective view of the slide 126 and the rail 124 with the engagement piston 146 placed in the disengaged position. FIG. 12*b* is a top view of the slide 126 and the rail 124 with the engagement piston 146 in the disengaged position. When in the disengaged position, the engagement piston 146 is moved in a sideways direction away from the side of the rail 124. When placed in the disengaged position, the engagement piston 146 is moved far enough away from the side of the rail 124 and is able to move freely over the engagement features 134. Thus, the slide 126 is slidable along the length of the rail 124. In some examples, the engagement piston 146 is biased into the engaged position. In such examples, continuous user input is required to keep the engagement piston 146 of the slide 126 in the disengaged position. For example, the user may be required to continue to depress a button-style engagement selector 136 to keep the engagement piston 146 in disengaged position and move the slide 126 back and forth along the rail 124. When the user releases the engagement selector 136, the engagement piston 146 reverts into the engaged position. In some examples, this engagement bias is accomplished by a spring-loaded engagement selector 136.

Figure 13:
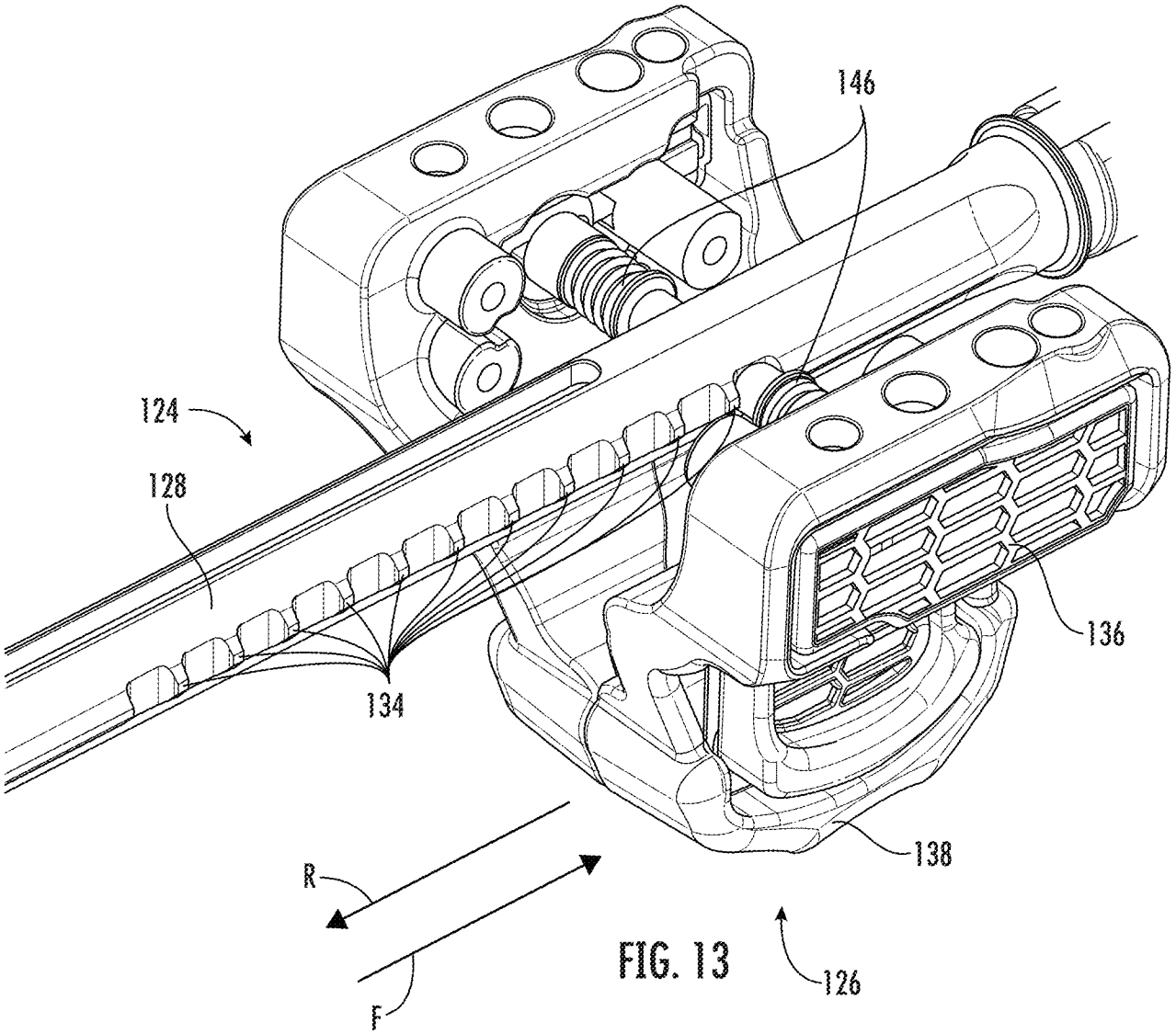
FIG. 13 is another top perspective view of the sliding assembly of FIG. 9 with the engagement pistons in an engaged position and a portion of the engagement sheath removed, according to an exemplary embodiment.
Figure 14:
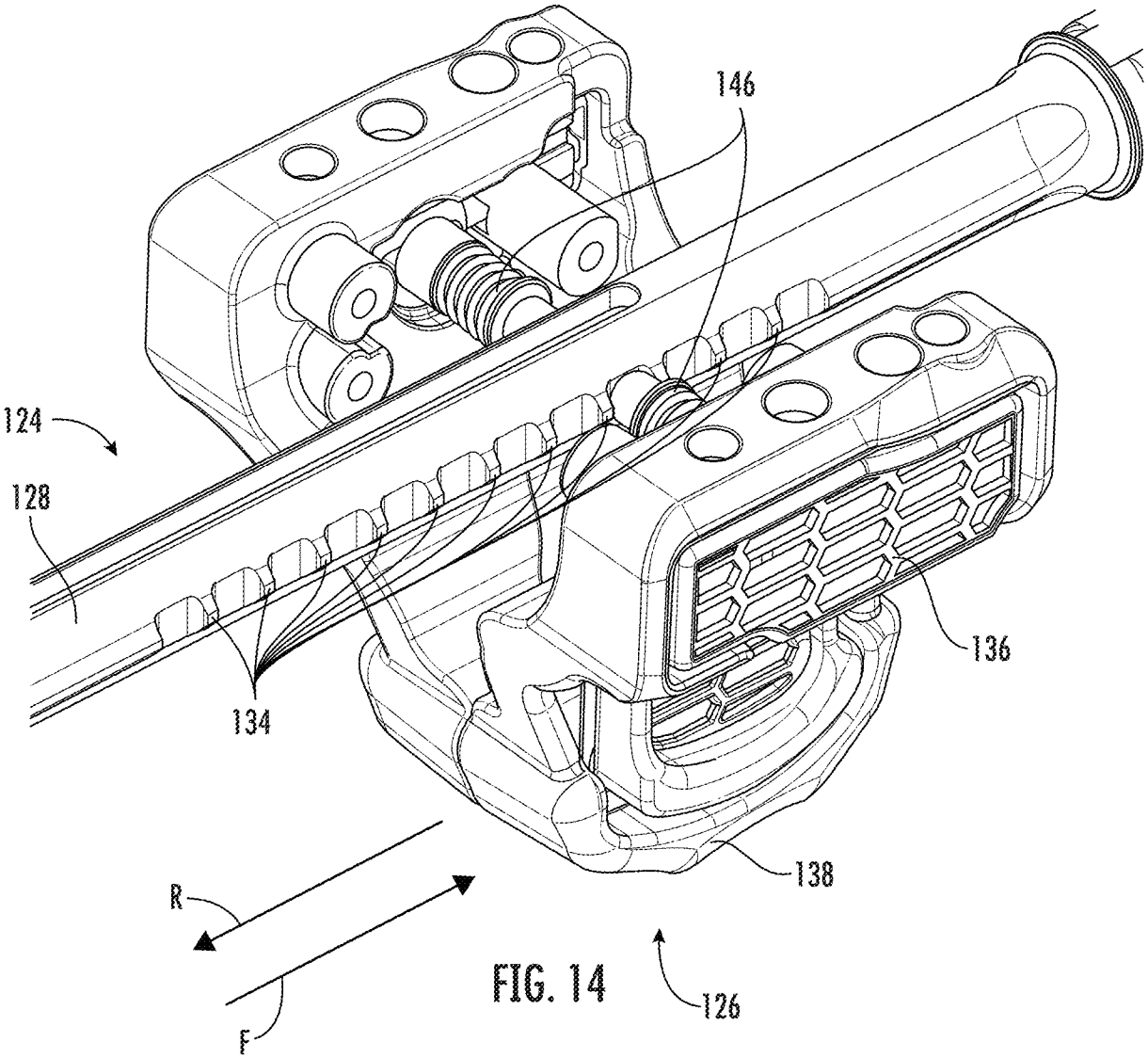
FIG. 14 is another top perspective view of the sliding assembly of FIG. 9 with the engagement pistons in an engaged position and a portion of the engagement sheath removed, according to an exemplary embodiment.

FIGS. 13-14 show the engagement piston 146 contacting an engagement feature 134. The engagement piston 146 can contact both a forward side and a rearward side of the engagement feature 134. In other examples, the engagement piston 146 can contact one of a forward side and a rearward side of the engagement feature 134. As depicted in FIGS. 13-14, the engagement features 134 are bidirectional and can function to prevent the engagement piston 146 from moving in either a rearward or forward direction. FIG. 13 shows the engagement piston 146 contacting a forward side and a rearward side of an engagement feature 134. In the example of FIG. 13, the forward side of a first engagement feature 134 prevents the slide 126 from moving in a rearward direction, depicted by arrow R. FIG. 14 shows the engagement piston 146 contacting a rearward side of a second engagement feature 134 and a forward side of a third engagement feature 134. In the example of FIG. 14, the rearward side of the second engagement feature 134 prevents the slide 126 from moving in a forward direction, depicted by arrow F, and the forward side of the third engagement feature 134 prevents the slide 126 from moving in the rearward direction.

Due to the slidable nature of the engagement piston 146 over the engagement features 134, and the variable positionality of the engagement piston 146, the situation may arise where the engagement piston 146 is placed into the engaged position while the engagement piston 146 is positioned over an engagement feature 134.

Figure 15:
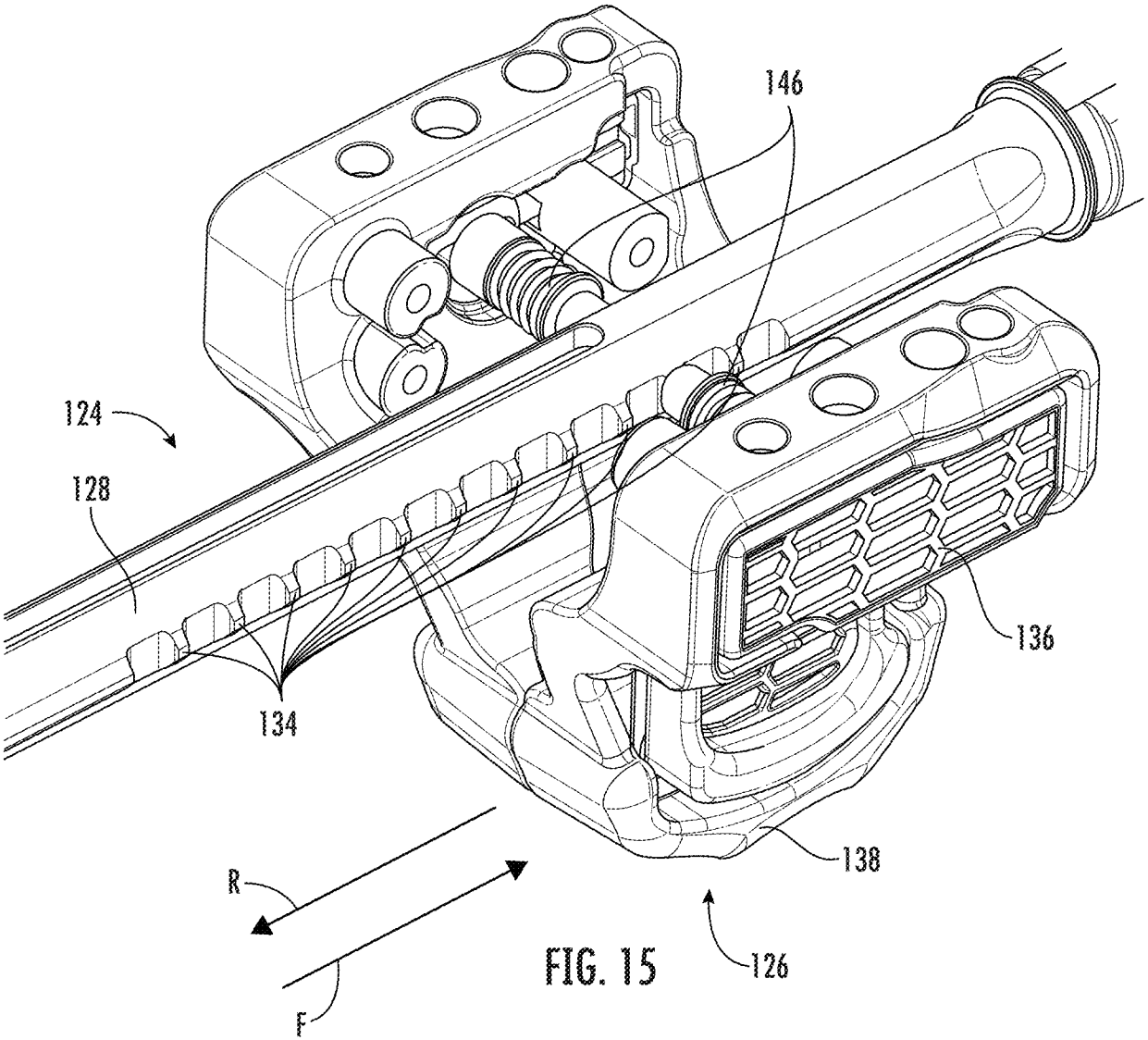
FIG. 15 is another top perspective view of the sliding assembly of FIG. 9 with the engagement pistons in an engaged position and a portion of the engagement sheath removed, according to an exemplary embodiment.

FIG. 15 depicts the situation where the engagement piston 146 is placed into the engaged position while the engagement piston 146 is positioned over an engagement feature 134. In this situation, the engagement bias continues to push the engagement piston 146 into the rail 124, even though the engagement piston 146 is not positioned in a space between the engagement features 134. Because the engagement piston 146 is not positioned in the space, the slide 126 (e.g., the actuator 126) remains free to move in a frontward or rearward direction. However, because the engagement piston 146 remains pushed into the rail 124, as the slide 126 moves forward or rearwardly, the engagement piston 146 eventually is moved off of the engagement feature 134 into a space adjacent the engagement feature 134, as depicted in FIGS. 13 and 14.

Figure 16:
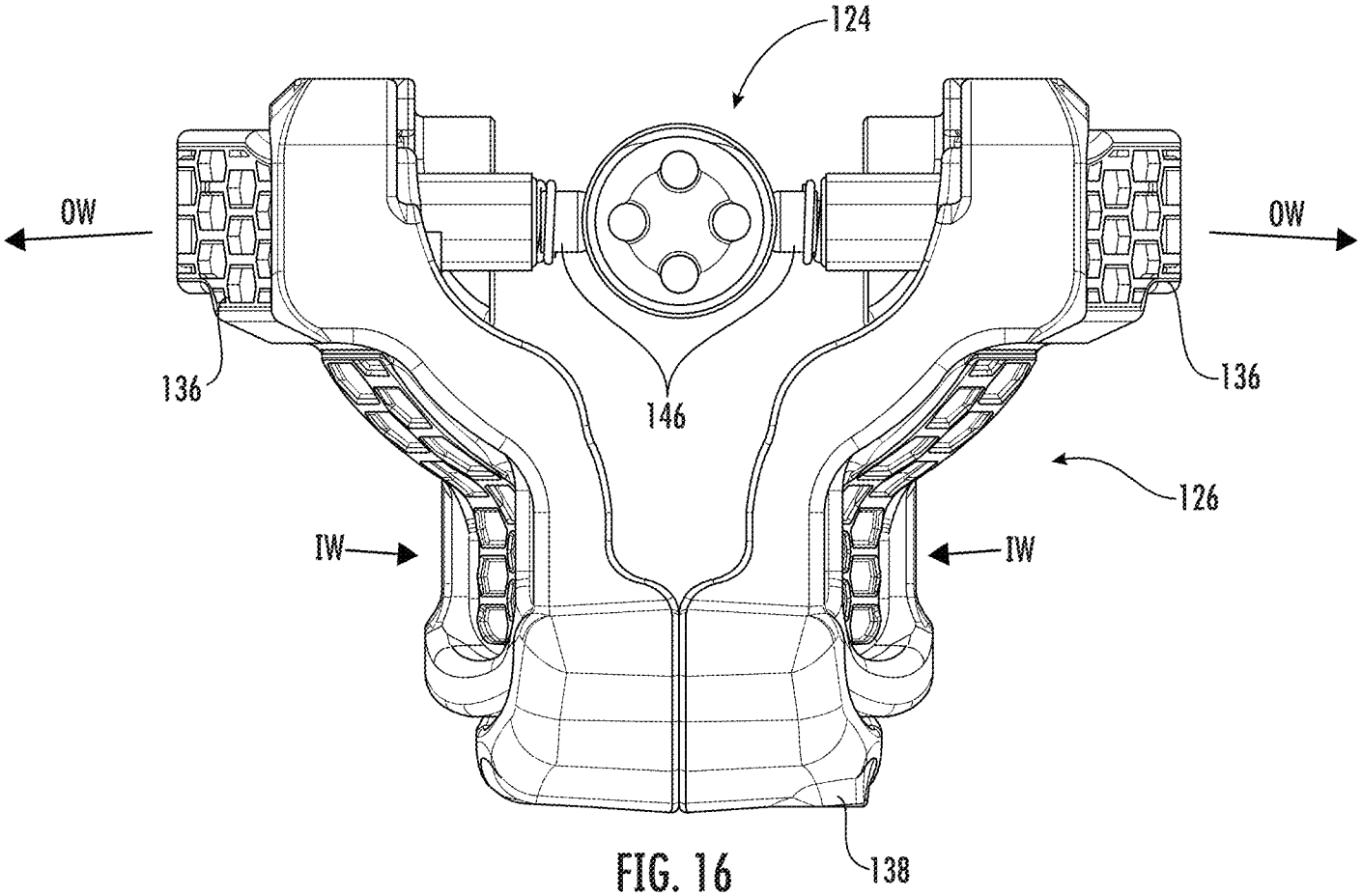
FIG. 16 is a front view of a portion of the rail and slide depicting a manipulation of an engagement selector, according to an exemplary embodiment.

FIG. 16 shows an example engagement selector 136 that is manipulated to move the engagement piston 146 into a disengaged position. In some examples, the engagement piston 146 is coupled to the engagement selector 136 so that manipulation of the engagement selector 136 places the engagement piston 146 into the engaged position or disengaged position by moving the engagement piston 146 away from or towards the rail 124, as depicted in FIGS. 11-12. In the example of FIG. 16, the engagement selector 136 is a depressible button. The depressible button is depressible on a bottom portion so that the bottom portion of the depressible button is movable in an inward direction, as shown by arrows IW. As the depressible button is depressed in an inward direction, the depressible button pivots about a mid-point of the depressible button so that the top portion of the depressible bottom moves outwardly in a direction away from the rail 124, as shown by arrows OW. Because the top portion of the depressible button is coupled to the engagement piston 146, the movement of the top portion of the depressible button away from the rail 124 results in the movement of the engagement piston 146 away from the rail 124. This results in engagement piston 146 being placed into a disengaged position so that the slide 126 is freely slidable along the rail 124. As the bottom portion of the engagement selector 136 is released by the user, the top portion pivots back towards the rail 124. The pivoting of the top portion results in the engagement piston 146 moving back towards the rail 124 and engaging with the engagement features 134. This results in the engagement piston 146 being put back into the engaged position, which restricts the movement of the slide 126.

Figure 17:
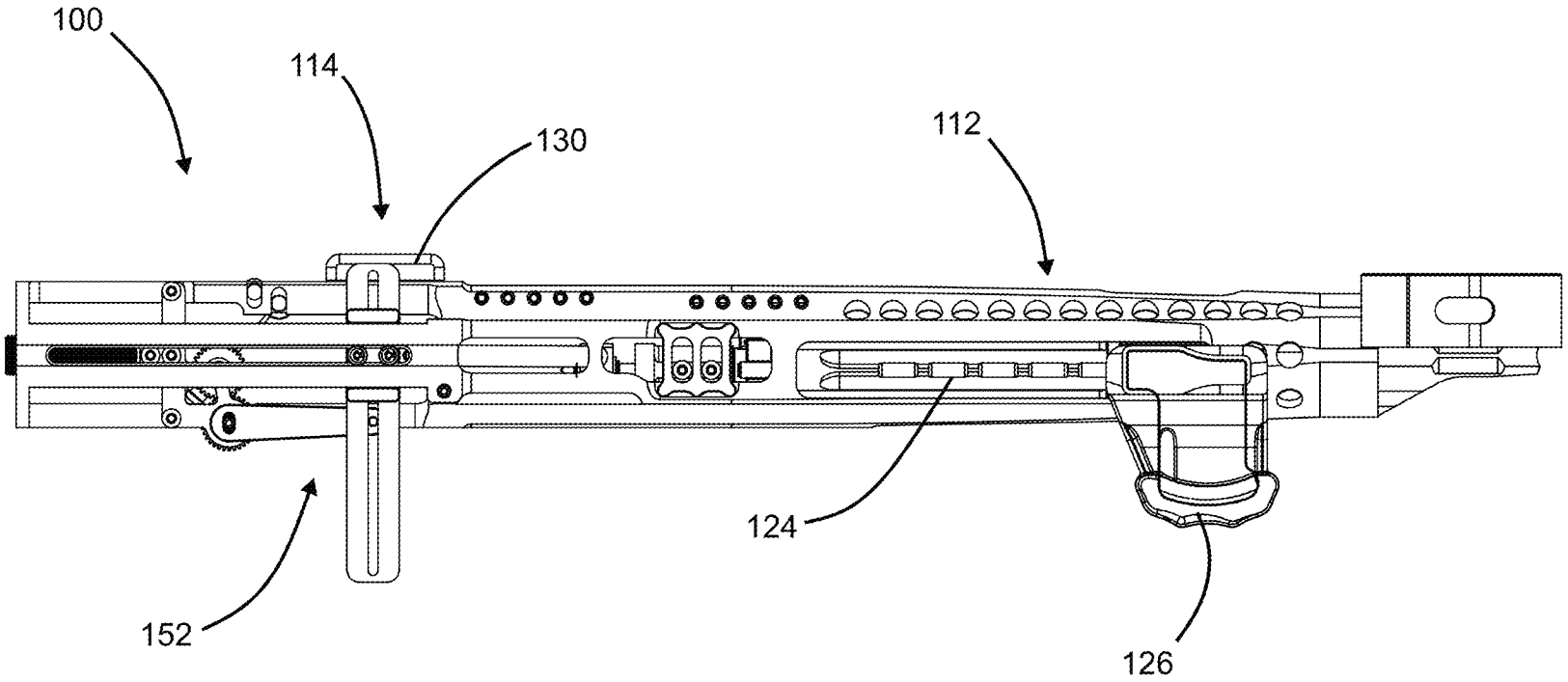
FIG. 17 is a side view of a crossbow with limbs and a stock removed, according to an exemplary embodiment.

FIG. 17 is a side view of the crossbow 100 with the stock 120 and limbs 108 removed. FIG. 17 depicts the sliding assembly 112 and spooling assembly 114. In some examples, the spooling assembly 114 includes a drawstring carrier 130 and a linear to rotational motion assembly 152.

The drawstring carrier 130 is configured to selectively retain the drawstring 106. In some examples, the drawstring carrier 130 is movable in a forwardly and rearwardly direction along the length of the crossbow 100. The spooling assembly 114 is operable to bring the drawstring carrier 130 rearward. Because the drawstring carrier 130 selectively retains the drawstring 106, as the drawstring carrier 130 is brought rearward, the drawstring 106 is also brought rearward.

The linear to rotational motion assembly 152 is configured to convert linear motion into rotational motion. In some examples, the linear to rotational motion assembly 152 converts linear motion supplied by the sliding assembly 112 into rotational motion. In some examples, the rotational motion from the linear to rotational motion assembly 152 drives the movement of the drawstring carrier 130 along the length of the crossbow 100.

In the example of FIG. 17, the linear to rotational motion assembly 152 is shown in the form of a scotch yoke linear to rotational motion assembly 152. However, it should be appreciated that other types of linear to rotational motion assemblies 152 are known in the art and could be readily implemented in accordance with the present disclosure. For example, in other examples, the linear to rotational motion assembly 152 is, for example, a slider-crank mechanism, a crankshaft mechanism, a cam shaft mechanism, a ball screw mechanism, a lead screw mechanism, a roller screw mechanism, or a rack and pinion gearing mechanism. For example, the linear to rotational motion assembly 152 can include a rack and a pinion gear. The rack and pinion gear can be operatively coupled via gear teeth, for example. A movement of the rack (e.g., a linear translation of the rack in a rearward direction or a forward direction) can cause a rotation of the pinion gear. A movement of the pinion gear (e.g., rotation about an axis) can cause a linear motion of the rack (e.g., a linear translation of the rack in a rearward direction or a forward direction).

In the example of FIG. 17, the movement of the slide 126 along the rail 124 of the sliding assembly 112 results in linear motion. The linear motion results in the operation of the spooling assembly 114. The spooling assembly 114 operates as the linear to rotational motion assembly 152 convers the linear motion from the sliding assembly 112 into rotational motion, which draws the drawstring carrier 130 rearward. The linear motion of the rod 142 (or some other linear coupling member 142) of the sliding assembly 112 (e.g., forward and rearward movement by the rod 142) drives rotational motion of the spooling assembly 114 and the spool 162. In some embodiments, the rod 142 of the sliding assembly 112 and the spool 162 of the spooling assembly 114 are linked by way of a scotch yoke linkage system.)

Figure 18:
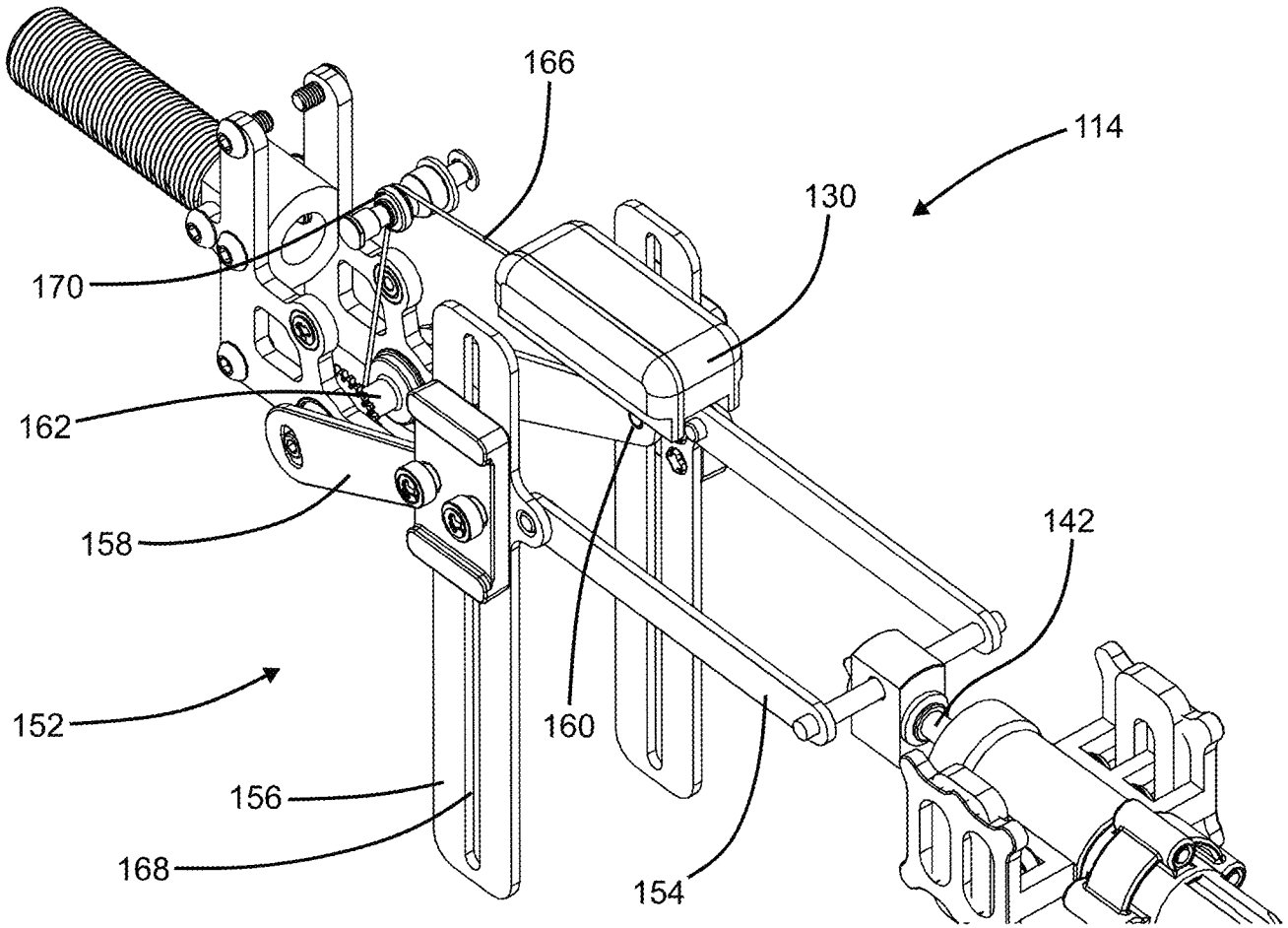
FIG. 18 is a top perspective view of a spooling assembly of the crossbow of FIG. 17, according to an exemplary embodiment.

FIG. 18 is a perspective view of an example spooling assembly 114, along with a portion of the sliding assembly 112. In this example, the spooling assembly 114 includes the drawstring carrier 130 and the linear to rotational motion assembly 152. The linear to rotational motion assembly 152 further includes a connecting bracket 154, a sliding yoke 156, a crank arm 158, a sliding pin 160, a spool 162, a tether 166, and a routing surface 170.

The connecting bracket 154 connects the spooling assembly 114 to a linear motion input. In the example of FIG. 18, the connecting bracket 154 connects the spooling assembly 114 to the sliding assembly 112. In the example of FIG. 18, a front end of the connecting bracket 154 is connected to a rear end of the rod 142 of the sliding assembly 112. This connection between the connecting bracket 154 and rod 142 results in the forward and rearward movement of the connecting bracket 154 as the rod 142 is moved in a forward and rearward direction by the slide 126 (shown in FIGS. 19-27). In the example of FIG. 18, the connecting bracket 154 further a rearwardly extending arm. In some examples, such as in the example of FIG. 18, the connecting bracket 154 includes a pair of rearwardly extending arms.

The sliding yoke 156 is attached to the rearwardly extending arm of the connecting bracket 154. In some examples, such as in the example of FIG. 18, a pair of sliding yokes 156 are used so that one sliding yoke 156 is positioned on each side of the crossbow 100. In some examples, the pair of rearwardly extending arms of the connecting bracket 154 connect to each of the sliding yokes 156 of the pair of sliding yokes 156. As the connecting bracket 154 is moved forward and rearward by the rod 142 (e.g., the linear coupling member 142), the sliding yoke 156 also moves forward and rearward. The sliding yoke 156 is formed as an elongate plate, which defines a center track 168 that extends along the length the sliding yoke 156. In some examples, the sliding yoke 156 is oriented so that the center track 168 extends in a vertical direction. However, in other examples, the sliding yoke 156 is oriented so that the center track 168 extends in an angled direction. In some examples, the center track 168 extends substantially across the length of the sliding yoke 156 and extends completely through the thickness of the elongate plate that forms the sliding yoke 156. Thus, the center track 168 is formed as a grove along the length of the sliding yoke 156.

The sliding pin 160 is positioned within the center track 168 of the sliding yoke 156. Sliding pins 160 are sized so that the diameter of the sliding pin 160 is approximately equal to the width of the center track 168 of the sliding yoke 156. The sliding pin 160 is oriented so that the length of the sliding pin 160 extends through the thickness of the sliding yoke 156. In some examples, each sliding pin 160 is able to slide along the length of the center track 168 of the sliding yoke 156. In some examples, where multiple sliding yokes 156 are used, a sliding pin 160 is positioned within each of the center tracks 168 of the sliding yokes 156.

The crank arm 158 is connected to the sliding pin 160. In some examples, such as in the example of FIG. 18, multiple crank arms 158 are included and connect to multiple sliding pins 160. In other examples, a single crank arm 158 is included. In some examples, the sliding pin 160 is connected to the crank arm 158 at an inner end of the sliding pin 160, while in other examples, the sliding pin 160 is connected to the crank arm 158 at an outer end of the sliding pin 160. In some examples, the crank arm 158 includes two ends. In some examples, the crank arm 158 is connected to the sliding pin 160 at a first end and is rotatable about a second end of the crank arm 158. In some examples, the crank arm 158 is rotatable about a crank axis, which is oriented in a direction perpendicular to the projectile axis. In some examples, the second end of the crank arm 158 is connected to a spool or a gear. In some examples, the rotation of the crank arm 158 drives the movement of the spool or gear, which drives the rearward motion of the drawstring carrier 130. The length of the crank arm 158 is variable.

The spool 162 is rotatable about a spooling axis. In some examples, the spooling axis is parallel with the crank axis. In some examples, the spool 162 is coupled to the second end of the crank arm 158 so that as the crank arm 158 rotates around the second end, the spool 162 rotates. In some examples, the crank arm 158 is connected at the second end of the crank arm 158 to a gear that is coupled to the spool 162, so that as the crank arm 158 is rotated, the gear is rotated, which also rotates the spool 162. In some examples, the spool 162 is connected to multiple crank arms 158 so that one crank arm 158 is positioned on each end of the spool 162.

The tether 166 is connected at a first end to the drawstring carrier 130. In some examples, the tether 166 is connected to a rear end of the drawstring carrier 130 so that as the tether 166 is pulled, the drawstring carrier 130 moves in a rearward direction. In some examples, the tether 166 is connected at a second end to the spool 162. In some examples, the tether 166 is tied around the spool 162, while in other examples the spool 162 includes a hole through which the tether 166 is inserted and tied to. In some examples, as the spool 162 rotates, the tether 166 is wound around the spool 162 so that more tether 166 is wound onto the spool 162 as the spool 162 completes additional revolutions. In some examples, as the spool 162 is rotated around the spooling axis, the tether 166 is wound onto the spool 162. As the tether 166 is wound onto the spool 162, the drawstring carrier 130 is brought in a rearward direction. In some examples such as in the example of FIG. 18, the tether 166 is a string. However, in other examples, the tether 166 is formed from, for example, webbing, cord, twine, or other similar material.

The spool 162 may be formed in various shapes and sizes. In some examples, increasing the diameter of the spool 162 decreases the number of revolutions that the tether 166 makes around the spool 162 before the drawstring carrier 130 is brought rearward into a drawn position. In some examples, when the diameter of the spool 162 is increased, greater force is required to rotate the spool 162 and bring the drawstring carrier 130 into a drawn position. On the other hand, when the diameter of the spool 162 is decreased, less force is required to rotate the spool 162 and bring the drawstring carrier 130 into a drawn position.

In some examples, the linear to rotational motion assembly 152 also includes a routing surface 170. The routing surface 170 provides a surface around which the tether 166 is routed. In some examples, such as in the example of FIG. 18, the routing surface 170 allows the tether 166 to be routed in a direction that is parallel to the direction in which the drawstring carrier 130 moves. In some examples, the routing surface 170 directs the tether 166 from extending in a substantially vertical direction between the spool 162 and the routing surface 170, to a substantially horizontal direction between the routing surface 170 and the drawstring carrier 130. In some examples, such as the example of FIG. 18, the routing surface 170 is a pin. In some examples, the routing surface 170 is a pulley. In some examples, the tether 166 is routed around multiple pulleys between the first and second ends of the tether 166 as to reduce the force required to bring the drawstring carrier 130 rearward into a drawn position.

As illustrated in FIGS. 19-27, the movement of the sliding yoke 156 in a forward and rearward direction drives the rotation of the crank arm 158 about their second ends, which causes the spool 162 to rotate.

Figure 19:
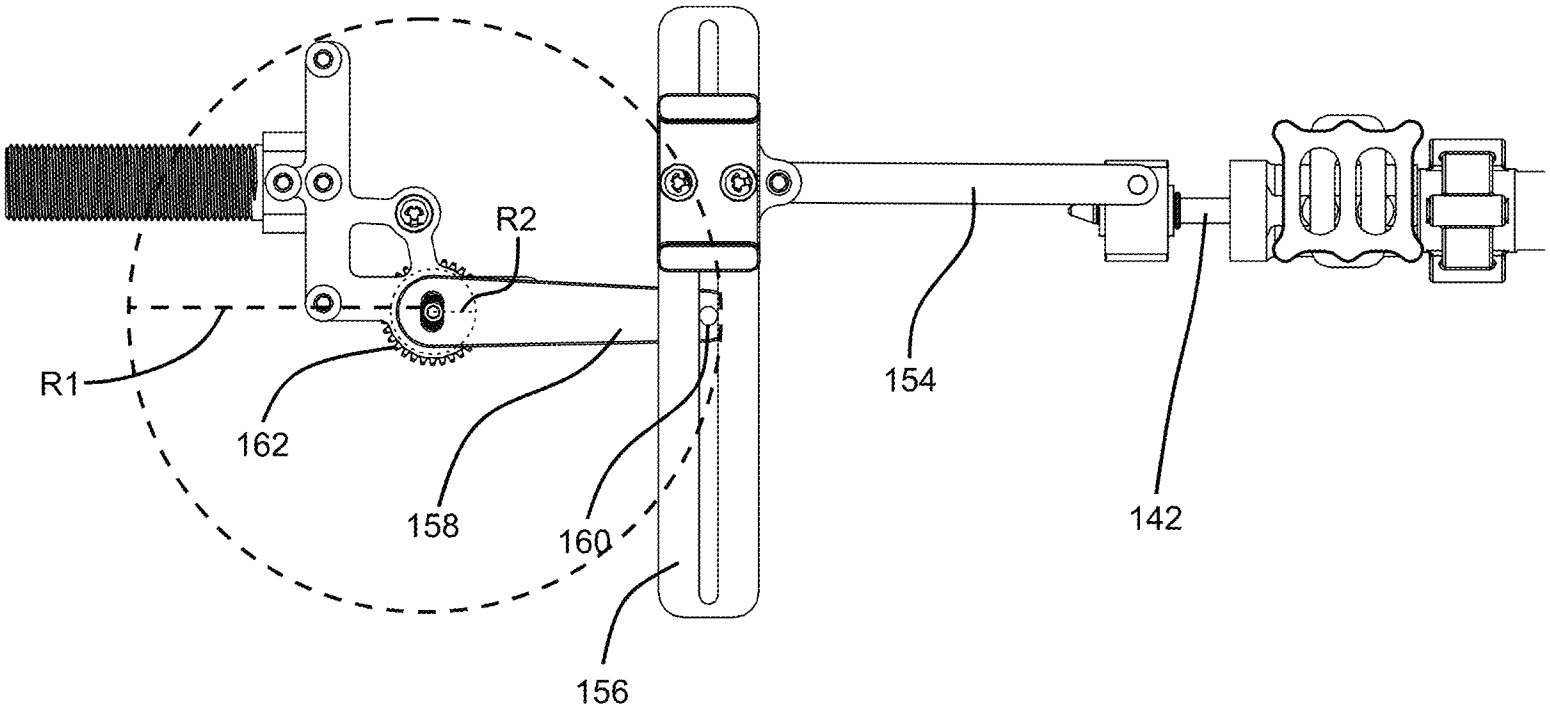
FIG. 19 is a side view of the spooling assembly of the crossbow of FIG. 17 in a first position, according to an exemplary embodiment.

FIG. 19 depicts the sliding yoke 156 in a forward position while the crank arm 158 are in a horizontal position. FIG. 19 further illustrates the movement of the crank arm 158 in FIGS. 19-27, shown by the dashed circle with the radius R1. Likewise, the movement of the spool, which is controlled by the movement of the crank arm 158, is illustrated by the dashed circle with the radius R2. In different embodiments, the lengths of R1 and R2 can vary. The effects of varying the size of R1 and R2 are discussed below.

Figure 20:
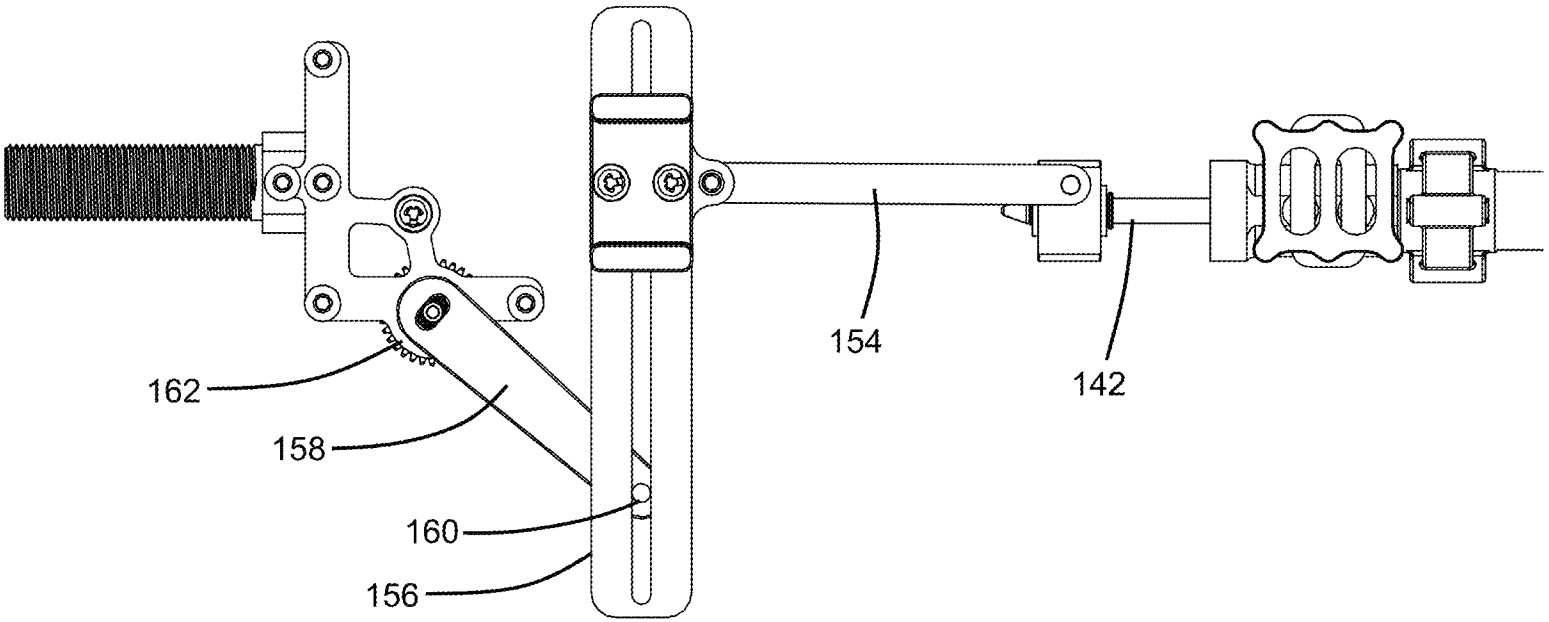
FIG. 20 is a side view of the spooling assembly of the crossbow of FIG. 17 in a second position, according to an exemplary embodiment.
Figure 21:
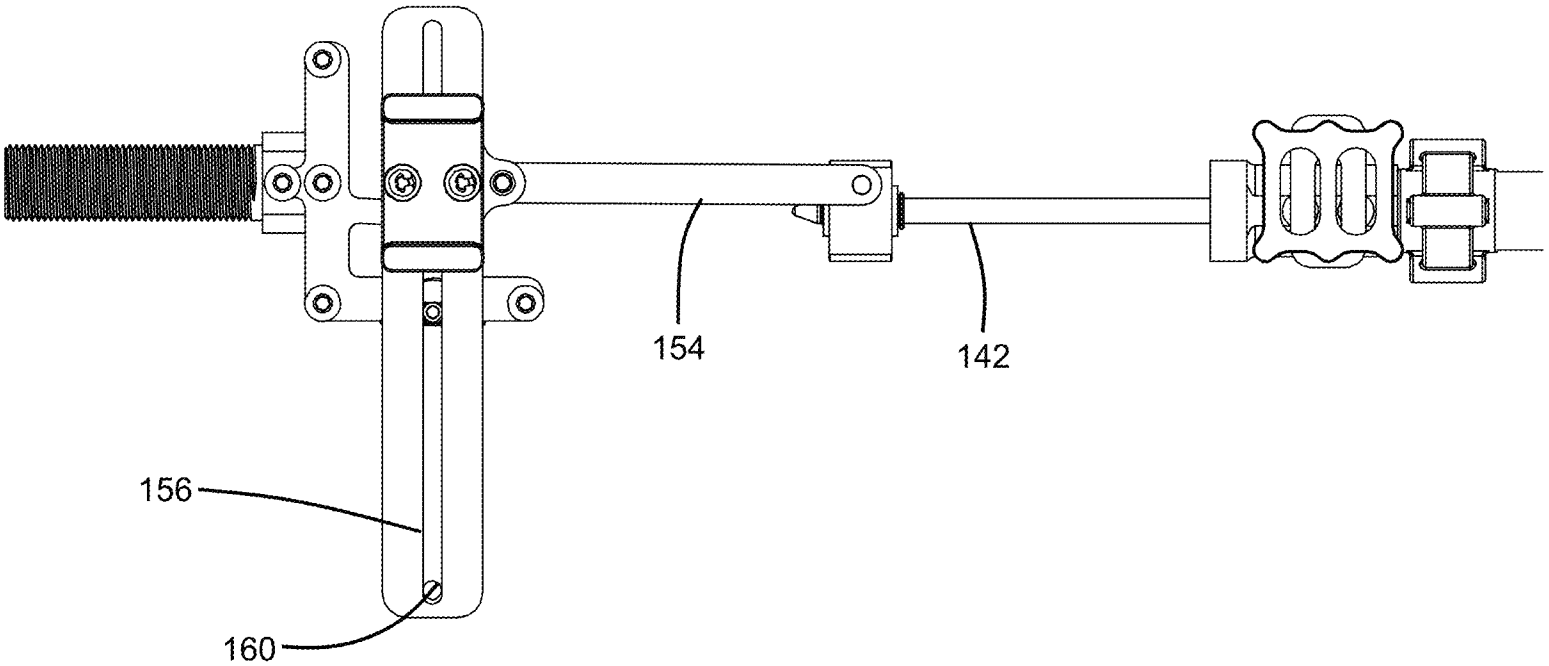
FIG. 21 is a side view of the spooling assembly of the crossbow of FIG. 17 in a third position, according to an exemplary embodiment.

In the examples of FIGS. 19-21, the initial rearward movement of the sliding yoke 156 (driven by the rearward movement of the slide 126 and rod 142) causes the sliding pin 160 to slide downward in the center track 168 which causes the crank arm 158 to rotate from the horizontal position depicted in FIG. 19 to a vertical position, where the first end is positioned below the second end, as depicted in FIG. 21. This concept is illustrated in FIGS. 19-21. FIG. 20 depicts the sliding yoke 156 in a partially forward position while the crank arm 158 is in a partially downward position. FIG. 21 depicts the sliding yoke 156 in a midpoint position while the crank arm 158 is in a downward position.

Figure 22:
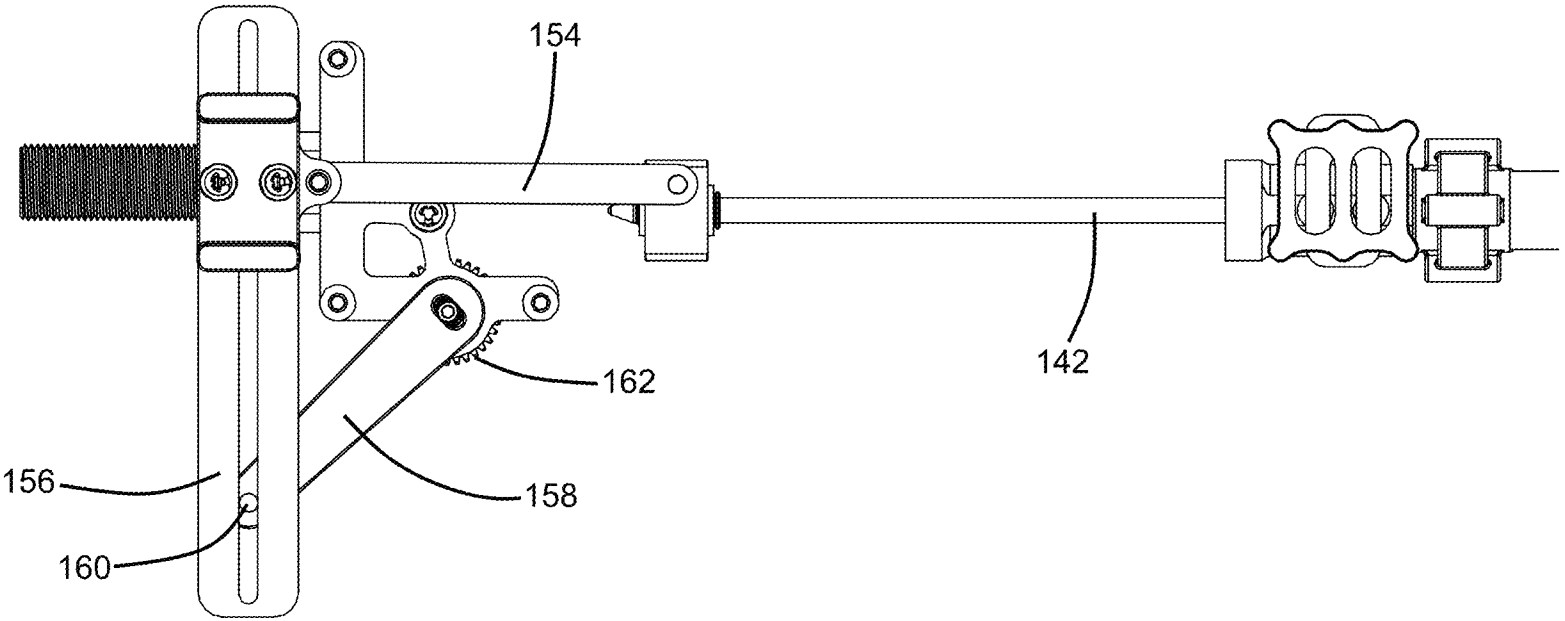
FIG. 22 is a side view of the spooling assembly of the crossbow of FIG. 17 in a fourth position, according to an exemplary embodiment.
Figure 23:
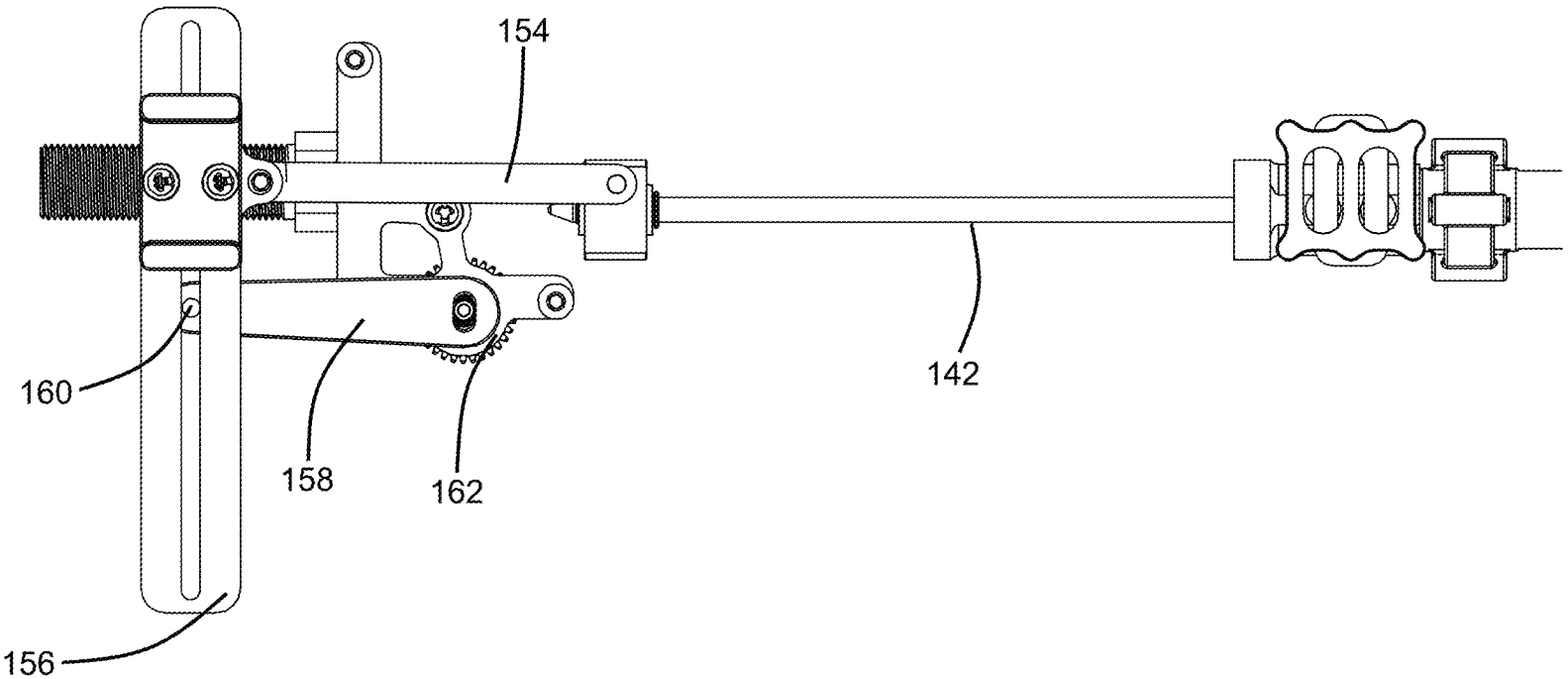
FIG. 23 is a side view of the spooling assembly of the crossbow of FIG. 17 in a fifth position, according to an exemplary embodiment.

In the examples of FIGS. 21-23, the further rearward movement of the sliding yoke 156 causes the sliding pin 160 to slide upward in the center track 168 which causes the crank arm 158 to rotate from the downward position depicted in FIG. 21 to a horizontal position, where the first end is positioned rearward of the second end, as depicted in FIG. 23. This concept is illustrated in FIGS. 21-23. FIG. 22 depicts the sliding yoke 156 in a partially rearward position while the crank arm 158 is in a partially downward position. FIG. 23 depicts the sliding yoke 156 in a rearward position while the crank arm 158 is in a horizontal position.

Figure 24:
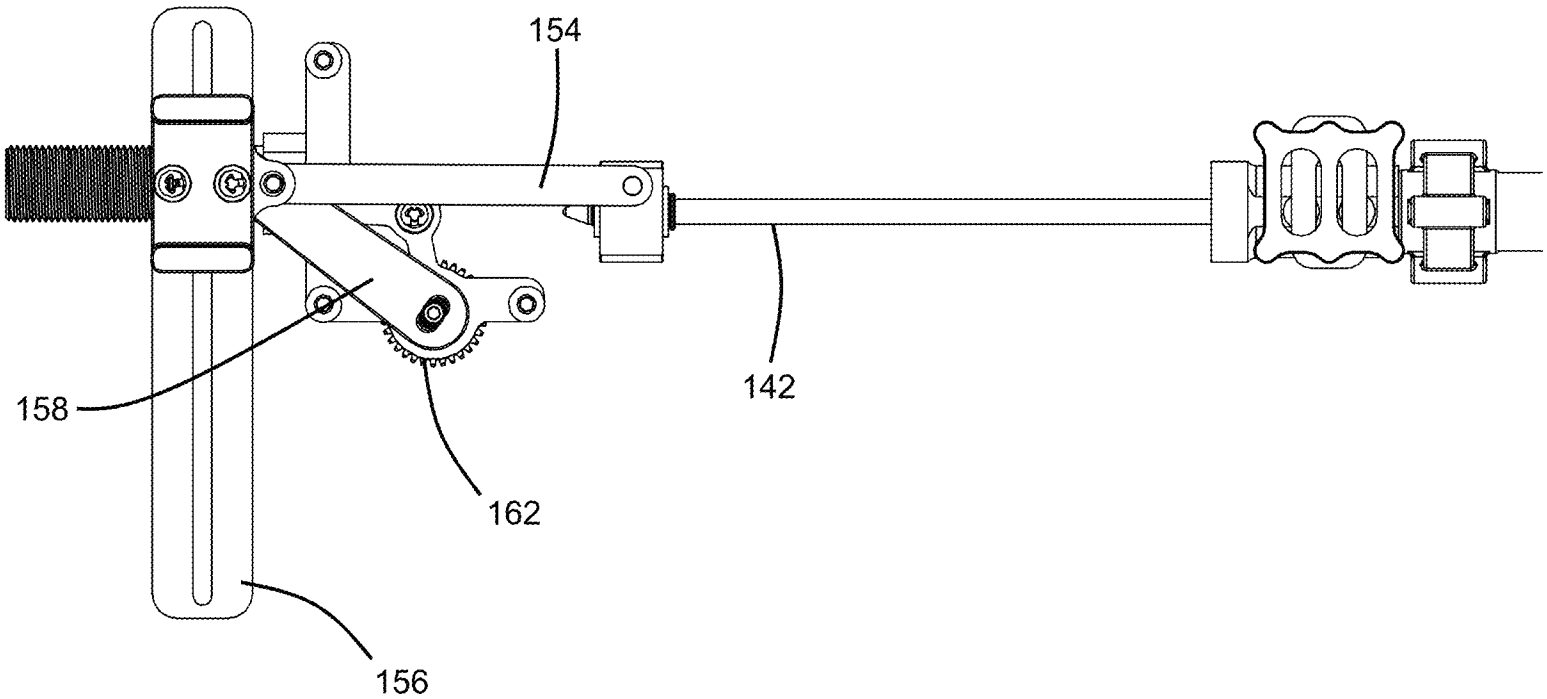
FIG. 24 is a side view of the spooling assembly of the crossbow of FIG. 17 in a sixth position, according to an exemplary embodiment.
Figure 25:
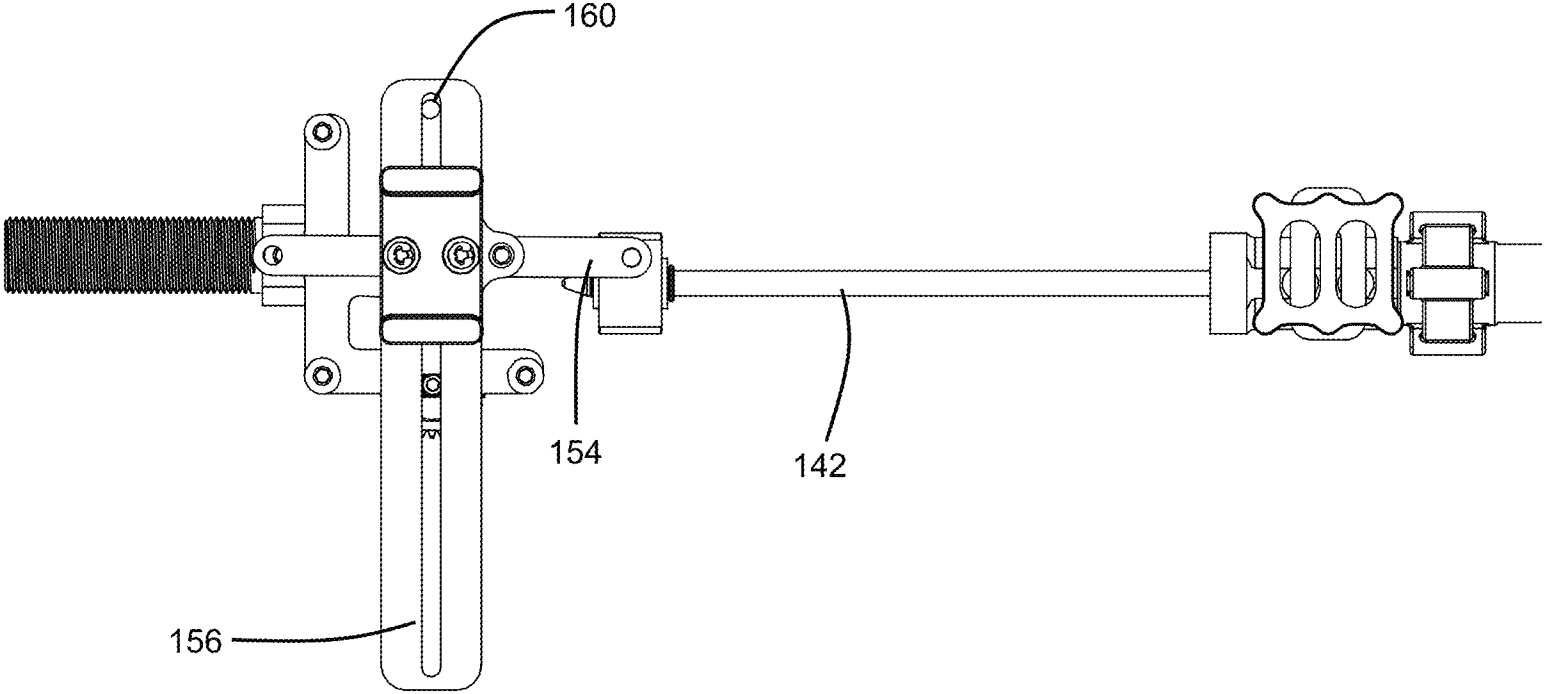
FIG. 25 is a side view of the spooling assembly of the crossbow of FIG. 17 in a seventh position, according to an exemplary embodiment.

In the examples of FIGS. 23-25, the initial forward movement of the sliding yoke 156 causes the sliding pin 160 to slide upward in the center track 168 which causes the crank arm 158 to rotate from the horizontal position depicted in FIG. 23 to an upward position, where the first end is positioned above the second end, as depicted in FIG. 25. This concept is illustrated in FIGS. 23-25. FIG. 24 depicts the sliding yoke 156 in a partially rearward position while the crank arm 158 is in a partially upward position. FIG. 25 depicts the sliding yoke 156 in a midpoint position while the crank arm 158 is in an upward position.

Figure 26:
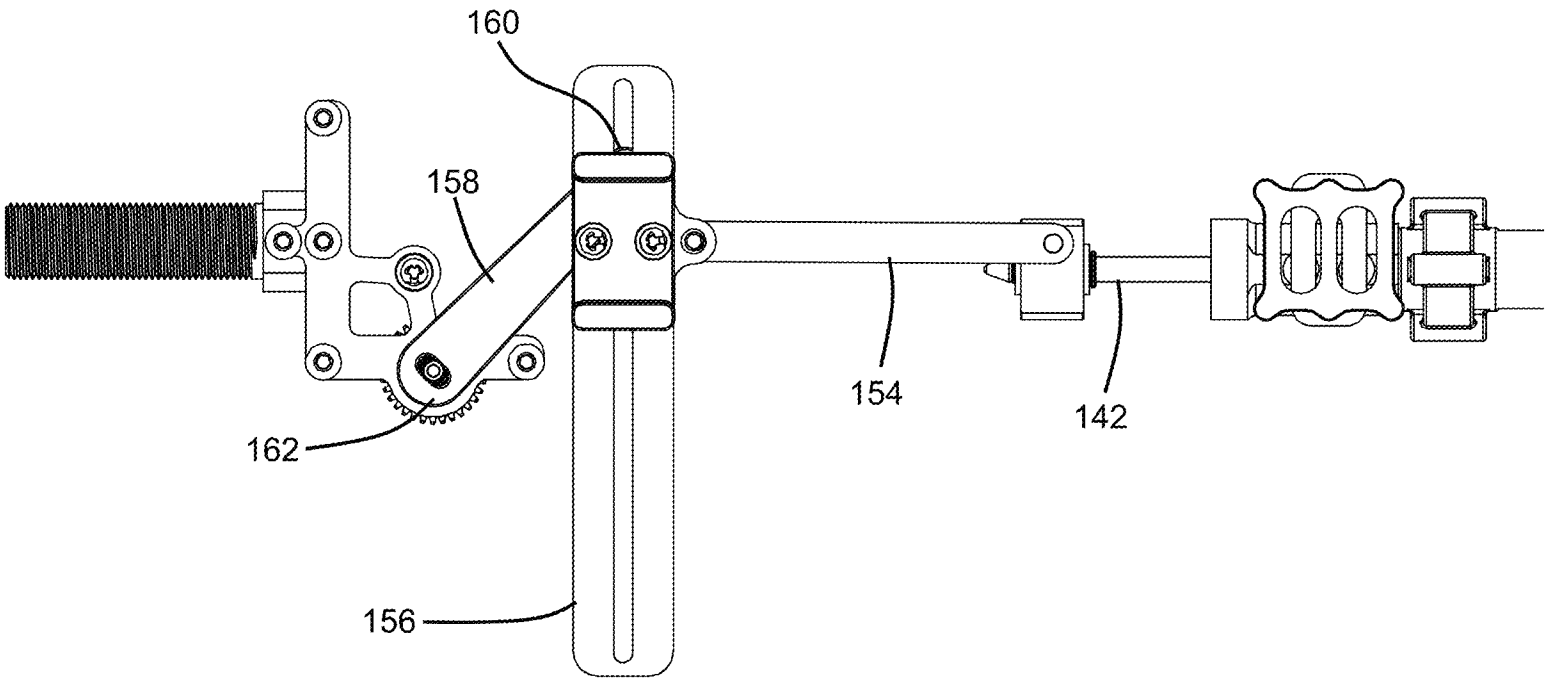
FIG. 26 is a side view of the spooling assembly of the crossbow of FIG. 17 in an eighth position, according to an exemplary embodiment.
Figure 27:
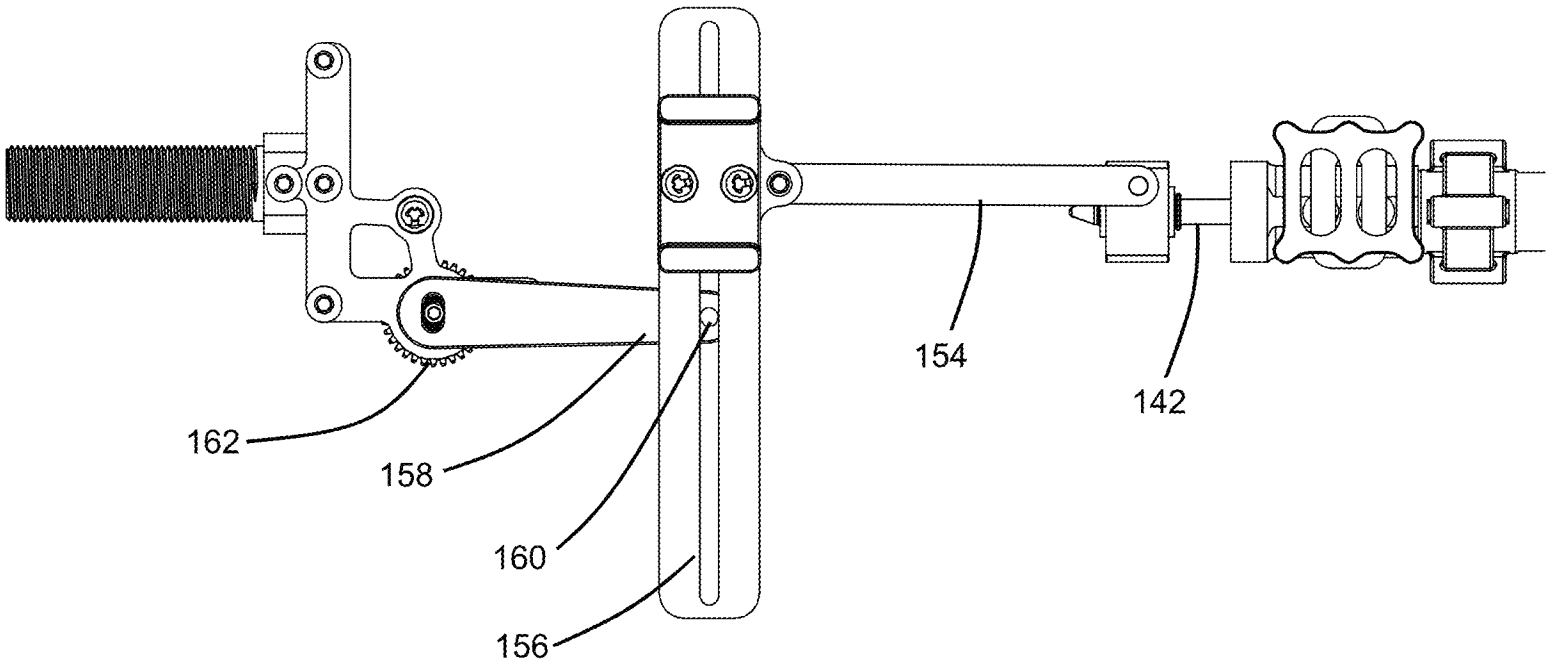
FIG. 27 is a side view of the spooling assembly of the crossbow of FIG. 17 back in the first position.

In the examples of FIGS. 25-27, the further forward movement of the sliding yoke 156 causes the sliding pin 160 to slide downward in the center track 168 which causes the crank arm 158 to rotate from the upward position in FIG. 25 back to the horizontal position, where the first end is positioned forward of the second end. This concept is illustrated in FIGS. 25-27. FIG. 26 depicts the sliding yoke 156 in a partially forward position while the crank arm 158 is in a partially upward position. FIG. 27 depicts the sliding yoke 156 in a forward position while the crank arm 158 is in a horizontal position.

As described with reference to FIGS. 19-27, the movement of the sliding yoke 156 from a forward position to a rearward position and back to a forward position results in the clockwise rotation of the spool 162, when viewed from a right side of the crossbow 100. However, in other examples, this same movement of the sliding yoke 156 results in the counterclockwise rotation of the spool 162. The movement of the sliding yoke 156 and crank arm 158 resulting in the counterclockwise rotation of the spool 162 is illustrated when viewing FIGS. 19-27, moving in an opposite order (starting with FIG. 27 and ending with FIG. 19).

Figure 28:
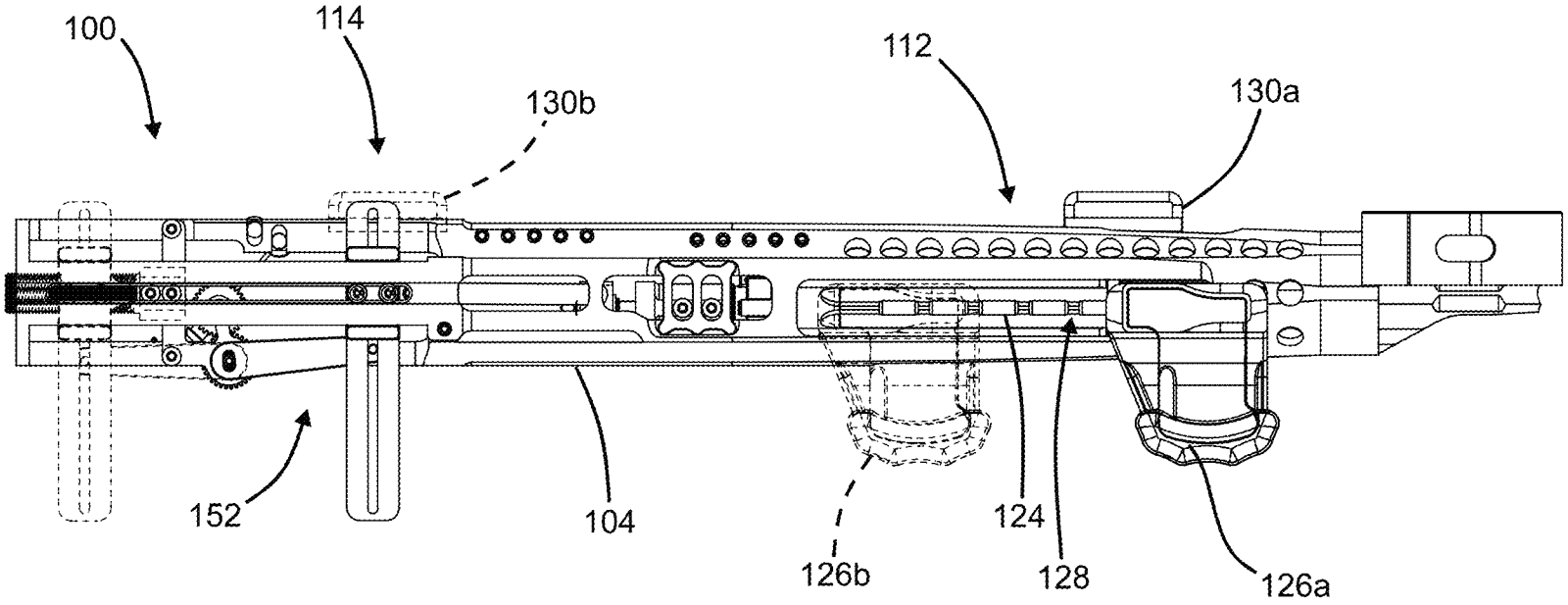
FIG. 28 is a side view of the crossbow of FIG. 17 showing the movability of the slide and a drawstring carrier, according to an exemplary embodiment.

FIG. 28 is a side view of the crossbow 100 with the limbs 108 and stock 120 removed. As noted with reference to FIG. 17, in some examples, the crossbow 100 includes both the sliding assembly 112 and the spooling assembly 114.

In some examples, the sliding assembly 112 and spooling assembly 114 work together to load the crossbow 100 by moving the drawstring carrier 130 (and the drawstring 106) rearwardly from the front end 116 of the crossbow 100 (as shown by reference number 130*a*) to the rear end 118 of the crossbow 100 (as shown by 130*b*). In some examples, this is accomplished by moving the slide 126 along the slide track 128 between a first position at the front of the crossbow 100 (as shown by 126*a*) to a second position rearward of the front of the crossbow 100 (as shown by 126*b*)

As the crossbow 100 is loaded, the force exerted by the limbs 108 makes it more difficult to move the drawstring 106 (and drawstring carrier 130) rearward. Consequently, this also makes it more difficult for the slide 126 to be slid along the rail 124. Generally, a user must apply force to move the slide 126 along the length of the rail 124. In some examples, the user must apply sufficient force to the slide 126 to overcome the force exerted by the limbs 108 that pushes the slide 126 in the opposite direction. In some examples, if the user were to cease applying force to the slide 126 after the drawstring carrier 130 has already been moved rearwardly along the frame 104, the force of the limbs 108 could propel the slide 126, drawstring 106, and drawstring carrier 130 in a forward direction, thereby resulting in a "dry fire." A dry fire may be undesirable due to a potential to cause damage to components of the crossbow 100.

In some examples, the sliding assembly 112 operates to prevent the occurrence of a dry fire. If, for example, the user lets go of the slide 126 after having already moved the slide 126 along the length of the rail 124, normally, one would expect a dry fire to result. However, by using the sliding assembly 112, when the user lets go of the slide 126, the user releases contact with the engagement selector 136. This causes the engagement piston 146 to contact the engagement features 134 on the rail 124 and halt the movement of the slide 126. By stopping the movement of the slide 126, the sliding assembly 112 prevents the crossbow 100 from dry firing.

As the slide 126 is slid along the rail 124, the sliding and spooling assembly 114 function to move the drawstring carrier 130 rearward, thereby loading the crossbow 100. The sliding assembly 112 and spooling assembly 114 can be configured in various ways as to allow different types of movement of the slide 126 to load the crossbow 100. In some examples, force applied by a user to generate a single movement of the slide 126 rearwardly along the length of the rail 124 (from 126*a* to 126*b*) results in the moving the drawstring carrier 130 moving to a loaded position at the rear of the frame 104 (from 130*a* to 130*b*). Alternatively, in other examples, force applied by a user to generate a single movement of the slide 126 forwardly along the length of the rail 124 (from 126*b* to 126*a*) results in moving the drawstring carrier 130 to the loaded position at the rear of the frame 104 (from 130*a* to 130*b*).

Alternatively, in some examples, multiple movements of the slide 126 (back and forth between 126*a* and 126*b*) may move the drawstring carrier 130 to the loaded position at the rear of the frame 104 (from 130*a* to 130*b*). In these examples, a user may be required to apply force to the slide 126 to generate movement of the slide 126 rearwardly along the length of the rail 124 (from 126*a* to 126*b*). Once the user moves the slide 126 to a rearward most point along the rail 124 (to 126*b*), the user may then apply force to the slide 126 in the opposite direction to generate movement of the slide 126 to a forwardmost point along the rail 124 (to 126*a*). In some examples, both the forward and rearward movement of the slide 126 incrementally moves the drawstring carrier 130 rearward.

In another example, only repeated rearward movement of the slide 126 incrementally moves the drawstring carrier 130 rearward. In this example, the user applies force to move the slide 126 in the rearward direction (from 126*a* to 126*b*). Once the slide 126 is moved to the rearward most point (at 126*b*), the slide 126 can be easily slid back to the forwardmost point (at 126*b*) without any opposing force. Then, the user can apply force to again move the slide 126 back to the rearward most point (at 126*b*). For example, the drawstring carrier 130 can move in the rearward direction (from 126*a* to 126*b*) with a movement of the slide 126 in the rearward direction. The drawstring carrier 130 can remain stationary or not move with a movement of the slide in the forward direction (from 126*b* to 126*a*).

In another example, only repeated forward movement of the slide 126 incrementally moves the drawstring carrier 130 rearward. In this example, the user applies force to move the slide 126 in the forward direction (from 126*b* to 126*a*). Once the slide 126 is moved to the forwardmost point (at 126*a*), the slide 126 can be easily slid back to the rearward most point (at 126*b*) without any opposing force. Then, the user can apply force to again move the slide 126 back to the forward most point (at 126*a*).

In some examples, increasing the number of movements of the slide 126 back and forth between positions 126*a* and 126*b* to move the drawstring carrier 130 to a position at the rear of the frame 104 (at 130*b*) decreases the force required to move the slide 126 along the slide track 128. In some examples, doubling the number of movements of the slide 126 to move the drawstring carrier 130 results in reducing the force required to move the slide 126 along the slide track 128 by one-half.

Referring back to FIG. 19 above, in some examples, varying the size of the spool 162 (illustrated by R2) and the size of the crank arm 158 (illustrated by R1), can have an impact on the amount of force required to move the slide 126 along the slide track 128. In some examples, increasing the size of the crank arm 158 (illustrated by R1), will require less force to move the slide 126 along the slide track 128. In some examples, decreasing the size of the crank arm 158 will require more force to move the slide 126 along the slide track 128 or to move some other actuator 126 in a forward or a rearward direction or about some pivot axis. In some examples, increasing the size of the spool 162 will require more force to move the slide 126 along the slide track 128. In some examples, decreasing the size of the spool 162 will require less force to move the slide 126 along the slide track 128.

In some examples, the relationship between the size of the crank arm 158 (R1) and the size of the spool 162 (R2) is illustrated by the equation:

$$F1*R1=F2*R2$$

Where F1 is the amount of force required to rotate the crank arm 158 along a circular trajectory of the crank arm 158 and F2 is the draw weight of the crossbow 100.

In some examples, increasing the size of the spool 162 results in fewer movements of the slide 126 along the slide track 128 necessary to bring the crossbow 100 into a drawn position. Alternatively, decreasing the size of the spool 162 requires additional movements of the slide 126 along the slide track 128 to bring the crossbow 100 into a drawn position.

In some embodiments, increasing the size of the crank arm 158 requires a longer slide track 128 along which the slide 126 must be slid to bring the crossbow 100 into a drawn position. Alternatively, decreasing the size of the crank arm 158 requires a shorter slide track 128 along which the slide 126 must be slid to bring the crossbow 100 into a drawn position.

In some examples, the crossbow 100 may be constructed so that ten full movements of the slide 126 back and forth along the slide track 128 with about 10-15 pounds of resistance results in the movement of the drawstring carrier 130 rearward. In some examples, the drawstring carrier 130 is moved about 14 inches rearward and pulls a draw weight of about 200 pounds.

Figure 29:
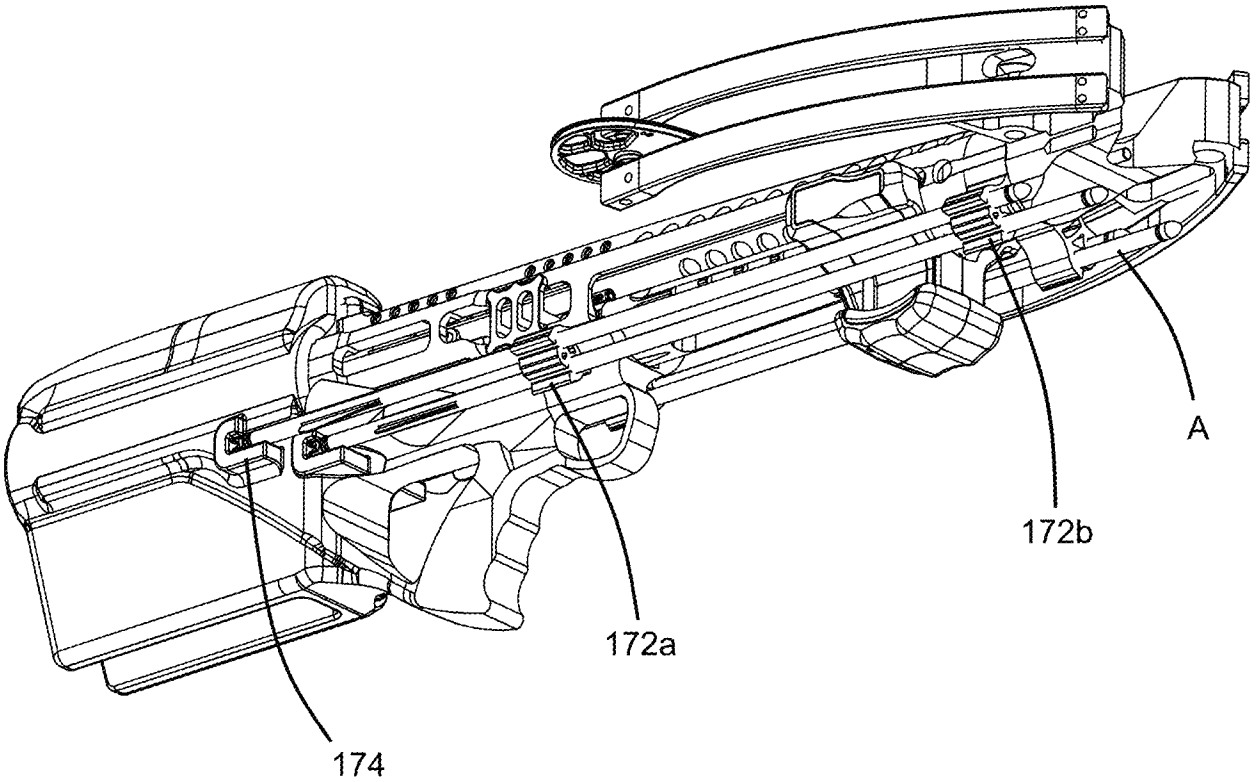
FIG. 29 is a bottom perspective view of another crossbow including one or more in-line arrow holders, according to an exemplary embodiment.

FIG. 29 is a bottom perspective view of another example crossbow 100. The example crossbow 100 includes one or more in-line arrow holders 172, one or more arrow recesses 174, and one or more arrows A.

The in-line arrow holders 172 are attached to the crossbow 100 at various points on the side of the crossbow 100. In the example of FIG. 29, the in-line arrow holders 172 are attached to the crossbow 100 at the front end 116 of the crossbow 100 and at a mid-point of the crossbow 100. In this embodiment, there is a front in-line arrow holder 172*b* and a rear in-line arrow holder 172*a*. In some embodiments, the in-line arrow holders 172 are configured to hold one or more arrows A onto the crossbow 100. In some embodiments, the in-line arrow holders 172 are formed from a rubber or plastic material and are attached to the crossbow 100 with fasteners. In some examples, the in-line arrow holders 172 are attached to the frame 104 of the crossbow 100 with mating features that are molded into the in-line arrow holders 172 and/or the frame 104 of the crossbow 100. In some examples, the in-line arrow holders 172 are manipulable so that an arrow A can be pushed into the in-line arrow holders 172 and held in an interference fit.

In some examples, the frame 104 of the crossbow 100 also includes one or more arrow recesses 174 for receiving a portion of an arrow A therein when the arrow A is placed into the in-line arrow holders 172. In some examples, such as the example of FIG. 29, the arrow recesses 174 are only present at the rear end of the arrows, while in other examples, the arrow recesses 174 are formed on the frame 104 along the length of the arrow A.

In some examples, the in-line arrow holders 172 are positioned such that an arrow can be mounted to the crossbow 100 on the left or right side of the crossbow 100 below the projectile axis P and above a trigger.

Figure 30:
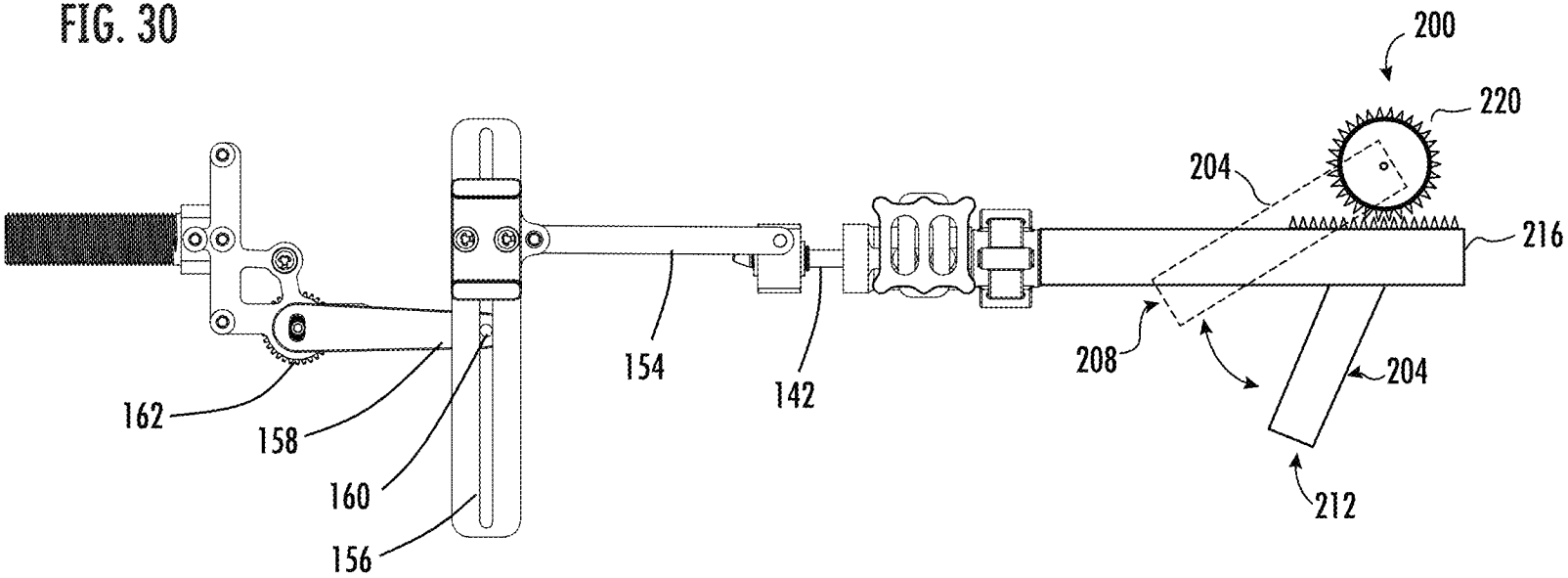
FIG. 30 is a side view of a lever assembly of the crossbow of FIG. 17, according to an exemplary embodiment.

In some embodiments, the cocking assembly 102 of the crossbow 100 includes another actuator 126 to move the drawstring carrier 130 in a rearward direction or some other direction (e.g., a forward direction). For example, the actuator 126 could be a lever assembly with a lever that can be pivoted about a pivot axis via a user input to cause the drawstring carrier 130 to move (e.g., to move rearward). The actuator 126 can be or include a knob or crank that can be turned, where the rotation of the knob or crank can cause the rod 142 to move, which can further cause the spooling assembly 114 to rotate and move the drawstring carrier 130. For example, the actuator 126 can be or include a lever assembly 200, as depicted in FIG. 30. The lever assembly 200 is operatable by a user and transfers an input force from the user to a linear force exerted on the spooling assembly 114. The spooling assembly 114 uses the transferred input force from the lever assembly 200 to draw and load the crossbow 100, as discussed in greater detail herein.

FIG. 30 depicts the lever assembly 200 in operation with the spooling assembly 114 and the rotational motion assembly 152. The lever assembly 200 includes a lever, shown as pump handle 204, actuatable between a stowed position 208 and a deployed position 212, a rack 216, and a pinion 220 coupled to the frame 104 and defining a center point about which the pump handle 204 pivots. The pump handle 204 is coupled to the pinion 220 such that an actuation of the pump handle 204 rotates the pinion 220 about the center point relative to the frame 104. A user may apply a force on the pump handle 204 to actuate the pump handle 204 between the stowed position 208 and the deployed position 212. In the deployed position 212, the user may apply a force on the pump handle 204 to actuate the pump handle 204 between the deployed position 212 and the stowed position 208. The pinion 220 includes gear teeth that are meshed with gear teeth of the rack 216. Actuating the pump handle 204 between the stowed position 208 and the deployed position 212 (e.g., pumping the lever assembly 200) rotates the pinion 220. Rotation of the pinion 220 engages the rack 216 to move linearly in a direction parallel to the projectile axis PA and relative to the frame 104. As the pump handle 204 is actuated from the stowed position 208 to the deployed position 212, the pinion 220 rotates counter clockwise (as viewed from FIG. 30) and the rack 216 moves in a forward direction. Similarly, as the pump handle 204 is actuated from the deployed position 212 to the stowed position 208, the pinion 220 rotates clockwise (as viewed from FIG. 30) and the rack 216 moves in a rearward direction.

The rod 142 (e.g., the linear coupling member 142) is coupled to the rack 216 such that as the rack 216 moves in the forward and the rearward directions, the rod 142 moves in a forward and rearward direction corresponding to the movement of the rack 216. Actuating the pump handle 204 engages the spooling assembly 114 to load the crossbow 100 by moving the drawstring carrier 130 (and the drawstring 106) rearwardly from the front end 116 of the crossbow 100 (as shown by reference number 130*a*) to the rear end 118 of the crossbow 100 (as shown by reference number 130*b*). In some embodiments, the pump handle 204 may be actuated at least partially between the stowed position 208 and the deployed position 212 to engage the spooling assembly 114 and load the crossbow 100. In some embodiments, multiple actuations of the pump handle 204 (back and forth between the stowed position 208 and the deployed position 212) may move the drawstring carrier 130 to the loaded position at the rear of the frame 104. In some examples, both the forward and rearward movement of the rack 216 incrementally moves the drawstring carrier 130 rearward.

In some embodiments, the lever assembly 200 utilizes another method (e.g., scotch yoke) that is not a rack and pinion gearing mechanism to engage the spooling assembly 114 and load the crossbow 100. For example, movement of the pump handle 204 can cause a piston, rod, or other element to plunge or move along some linear axis. The pump handle 204 can be a moment arm coupled to a pivot axis. The piston, rod, or sliding element can be retained or captured within a tube or housing such that the piston, rod, or sliding element is only permitted to move along an axis (e.g., an axis parallel with an axis of the rod 142). The piston, rod, or sliding element can coupled to the pivot axis via a linkage (e.g., an arm). A rotation of the pump handle 204 about the pivot axis can cause the linkage to slide the piston, rod, or sliding element along the axis. The piston, rod, or sliding element can further be coupled to the rod 142 to cause the rod 142 to move based on the movement of the piston, rod, or sidling element.

Figure 31:
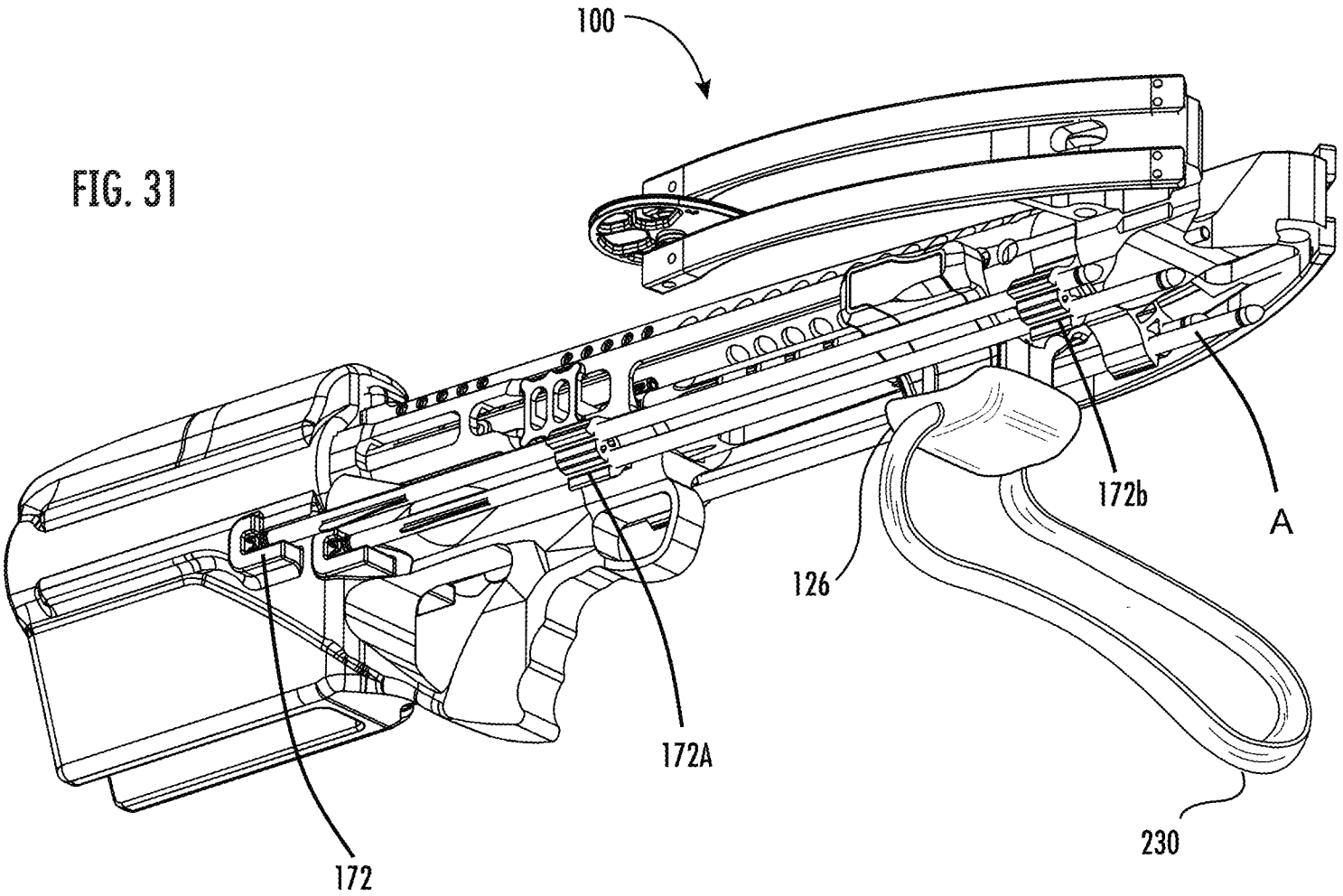
FIG. 31 is a bottom perspective view of a foot stirrup of the crossbow of FIG. 29, according to an exemplary embodiment.

As shown in FIG. 31, the crossbow 100 may include a cocking aid, shown as foot stirrup 230. The foot stirrup 230 is removably coupled to the slide 126 of the sliding assembly 112. In some embodiments, the foot stirrup 230 is integrally formed with the slide 126. In some embodiments, the foot stirrup 230 is removably coupled to or integrally formed with another component of the sliding assembly 112 and/or another component of the crossbow 100. The user places a foot in the foot stirrup 230 and applies a force to the foot stirrup 230 and/or another component of the crossbow 100 to slide the slide 126 in a forward and rearward direction to cock the crossbow 100. With the foot stirrup 230 installed, the sliding assembly 112 and the spooling assembly 114 operate substantially similar to the embodiment described in greater detail above.

Although the present disclosure refers to example implementations of the subject technology in a crossbow, other embodiments include other forms of projectile launchers. Accordingly, other embodiments can be formed by replacing the term "crossbow" with "projectile launcher" herein.

The various embodiments described above are provided by way of illustration only and should not be construed to limit the claims attached hereto. Those skilled in the art will readily recognize various modifications and changes that may be made without following the example embodiments and applications illustrated and described herein, and without departing from the full scope of the following claims.

What is claimed is:

1. A cocking assembly for a crossbow, the cocking assembly comprising:

a rail having a front end and a rear end;

a drawstring carrier configured to retain a drawstring and move in a rearward direction to draw the drawstring; and an actuator operatively coupled to the drawstring carrier and slidably engaged with the rail, the actuator configured to move along the rail between the front end and the rear end to move the drawstring carrier in the rearward direction.

2. The cocking assembly of claim 1, wherein the rail further comprises at least one engagement feature disposed along the rail between the front end and the rear end, the actuator configured to selectively engage the at least one engagement feature to arrest a movement of the actuator.

3. The cocking assembly of claim 2, further comprising:

the actuator configured to receive a user input to move the actuator along the rail, wherein the actuator is configured to disengage from the at least one engagement feature in response to the user input, wherein the actuator is configured to engage the at least one engagement feature in absence of the user input.

4. The cocking assembly of claim 2, wherein the actuator comprises a piston configured to selectively engage with the at least one engagement feature.

5. The cocking assembly of claim 4, wherein the actuator comprises an engagement selector that actuates the piston.

6. The cocking assembly of claim 1, wherein the actuator is further configured to move along the rail from the rear end to the front end in a forward direction, wherein a movement of the actuator in the forward direction is configured to draw the drawstring carrier in the rearward direction and a movement of the actuator in the rearward direction is configured to draw the drawstring in the rearward direction.

7. The cocking assembly of claim 1, wherein the actuator is further configured to move along the rail from the rear end to the front end in a forward direction, wherein the drawstring carrier is configured to move in the rearward direction with a movement of the actuator in the rearward direction and the drawstring carrier is configured to remain stationary with a movement of the actuator in the forward direction.

8. The cocking assembly of claim 1, wherein the actuator is further configured to move along the rail from the rear end to the front end in a forward direction, wherein the drawstring carrier is configured to move in the rearward direction with a movement of the actuator in the forward direction and the drawstring carrier is configured to remain stationary with a movement of the actuator in the rearward direction.

9. The cocking assembly of claim 1, further comprising:

a spool operatively coupled with the actuator; and a tether with a first end that is connected to the drawstring carrier and a second end that is connected to the spool;

wherein a movement of the actuator along the rail is configured to rotate the spool to wind the tether about the spool to draw the drawstring carrier in the rearward direction.

10. The cocking assembly of claim 1, wherein the actuator is further configured to move along the rail between the front end and the rear end to move the drawstring carrier in a forward direction.

11. The cocking assembly of claim 1, wherein the drawstring carrier is configured to move the drawstring to a loaded position in response to a plurality of movements of the actuator between the front end and the rear end.

12. A cocking assembly for a crossbow comprising:

a rail having a front end and a rear end;

a drawstring carrier;

an actuator operatively slidably coupled to the rail and, the actuator configured to move along the rail between the front end and the rear end; and a spool operatively coupled to the actuator and configured to rotate with a movement of the actuator along the rail, wherein a rotational movement of the spool is configured to move the drawstring carrier in a rearward direction.

13. The cocking assembly of claim 12, further comprising:

the actuator coupled to the spool via a rod, wherein the movement of the actuator is configured to cause a corresponding linear movement of the rod.

14. The cocking assembly of claim 13, wherein the linear movement of the rod is configured to cause the rotational movement of the spool.

15. The cocking assembly of claim 14, further comprising:

the rod coupled to the spool via a linear to rotational motion assembly, the linear to rotational motion assembly is a slider-crank mechanism, a crankshaft mechanism, a cam shaft mechanism, a ball screw mechanism, a lead screw mechanism, a roller screw mechanism, or a rack and pinion gearing mechanism.

16. The cocking assembly of claim 12, wherein the movement of the actuator comprises a translation between the front end and the rear end of the rail, wherein the drawstring carrier is configured to move a drawstring to a loaded position in response to a plurality of movements of the actuator.

17. A crossbow, comprising:

a drawstring; and a cocking assembly, comprising:

a rail having a front end and a rear end;

a drawstring carrier configured to retain the drawstring and draw the drawstring towards a rear end of the crossbow; and an actuator slidably engaged with the rail and configured to move along the rail between the front end and the rear end to draw the drawstring carrier towards the rear end of the crossbow.

18. The crossbow of claim 17, wherein the actuator is further configured to move along the rail from the rear end to the front end in a forward direction and from the front end to the rear end in a rearward direction, wherein a movement of the actuator in the forward direction is configured to draw the drawstring towards the rear end of the crossbow and a movement of the actuator in the rearward direction is configured to draw the drawstring towards the rear end of the crossbow.

19. The crossbow of claim 17, wherein the actuator is further configured to move along the rail from the rear end to the front end in a forward direction and from the front end to the rear end in a rearward direction, wherein the drawstring carrier is configured to move towards the rear end of the crossbow with a movement of the actuator in the rearward direction and wherein the drawstring carrier is configured to remain stationary with a movement of the actuator in the forward direction.

20. The crossbow of claim 17, further comprising:

the actuator configured to receive a user input to move the actuator along the rail, wherein the actuator is configured to disengage from an engagement feature of the rail in response to the user input, wherein the actuator is configured to engage the engagement feature in absence of the user input.

* * * * *